US007337730B2

(12) United States Patent
Bienick et al.

(10) Patent No.: US 7,337,730 B2
(45) Date of Patent: Mar. 4, 2008

(54) VERTICALLY ADJUSTABLE SHELVES AND REFRIGERATOR COMPARTMENT HOUSING THE SAME

(75) Inventors: Craig Bienick, Jenison, MI (US); Vincent L. Ramik, Annandale, VA (US)

(73) Assignee: Gemtron Corporation, Sweetwater, TN (US)

( * ) Notice: Subject to any disclaimer, the term of this patent is extended or adjusted under 35 U.S.C. 154(b) by 111 days.

(21) Appl. No.: 11/088,867

(22) Filed: Mar. 25, 2005

(65) Prior Publication Data

US 2005/0204966 A1 Sep. 22, 2005

Related U.S. Application Data

(63) Continuation-in-part of application No. 10/355,136, filed on Jan. 31, 2003, now Pat. No. 6,962,116.

(51) Int. Cl.
*A47B 9/00* (2006.01)

(52) U.S. Cl. ..... 108/108; 108/147.17; 312/408

(58) Field of Classification Search ..... 312/408, 312/410; 108/106–110, 147.16, 147.17; 211/187, 193, 103, 190, 217; 248/243–246, 248/220.43, 220.41
See application file for complete search history.

(56) References Cited

U.S. PATENT DOCUMENTS

| | | | | |
|---|---|---|---|---|
| 569,640 | A | 10/1896 | Hartzell | |
| 984,857 | A | 2/1911 | Schuftan | |
| RE19,798 | E | 12/1935 | Copeman | |
| 2,841,459 | A | 7/1958 | Sharpe | |
| 3,162,416 | A * | 12/1964 | Amarillas | 248/244 |
| 3,172,715 | A | 3/1965 | Powder | |
| 3,299,839 | A | 1/1967 | Nordbak | |
| 3,316,044 | A | 4/1967 | Carbary | |
| 3,479,974 | A | 11/1969 | Ferdinand et al. | |
| 3,536,015 | A | 10/1970 | Textoris | |
| 3,702,137 | A | 11/1972 | Evans | |
| 3,834,659 | A | 9/1974 | Siegel | |
| 3,888,440 | A | 6/1975 | Rebentisch | |
| 4,250,815 | A | 2/1981 | Swanson | |
| 4,934,645 | A | 6/1990 | Breslow | |
| 5,088,607 | A | 2/1992 | Risafi et al. | |
| 5,338,137 | A * | 8/1994 | Jensen | 211/187 |
| 5,441,338 | A | 8/1995 | Kane et al. | |

(Continued)

FOREIGN PATENT DOCUMENTS

| | | |
|---|---|---|
| CH | 665759 | 6/1988 |

(Continued)

*Primary Examiner*—Lanna Mai
*Assistant Examiner*—Hanh V. Tran
(74) *Attorney, Agent, or Firm*—Diller, Ramik & Wight

(57) ABSTRACT

A shelf assembly includes a shelf adapter bracket defined by a U-shaped shelf bracket member in legs of which are vertically disposed opposing slideways into which open a plurality of vertically spaced slots. A shelf includes a pair of shelf support brackets each having a pin which move in the slideways and seats in the slots to effect selective vertical adjustment of an associated shelf. The shelf adapter bracket has hooks for engaging in slots of conventional refrigerator trackways. The shelf includes lateral stabilizing ribs, a lubricity block, and a stop nose which engages a stop in a bight wall of the shelf bracket member to prevent inadvertent/accidental downward shelf movement.

44 Claims, 15 Drawing Sheets

U.S. PATENT DOCUMENTS

| | | | | |
|---|---|---|---|---|
| 5,483,902 | A * | 1/1996 | Grosch | 108/143 |
| 5,642,924 | A * | 7/1997 | Wohlrab et al. | 312/408 |
| 5,735,222 | A | 4/1998 | Webb | |
| 5,913,584 | A | 6/1999 | Swindell et al. | |
| 5,921,411 | A | 7/1999 | Meri | |
| 6,065,821 | A | 5/2000 | Anderson et al. | |
| 6,168,032 | B1 | 1/2001 | Meri | |
| 6,196,141 | B1 | 3/2001 | Herron, III et al. | |
| 6,227,636 | B1 | 5/2001 | Lye et al. | |
| 6,584,916 | B1 | 7/2003 | Felton et al. | |
| 6,675,725 | B2 | 1/2004 | Felton et al. | |
| 2002/0027115 | A1 | 3/2002 | Gay et al. | |

FOREIGN PATENT DOCUMENTS

| | | | |
|---|---|---|---|
| EP | 0235448 | | 9/1987 |
| GB | 1560724 | * | 2/1980 |

* cited by examiner

FIG. 1
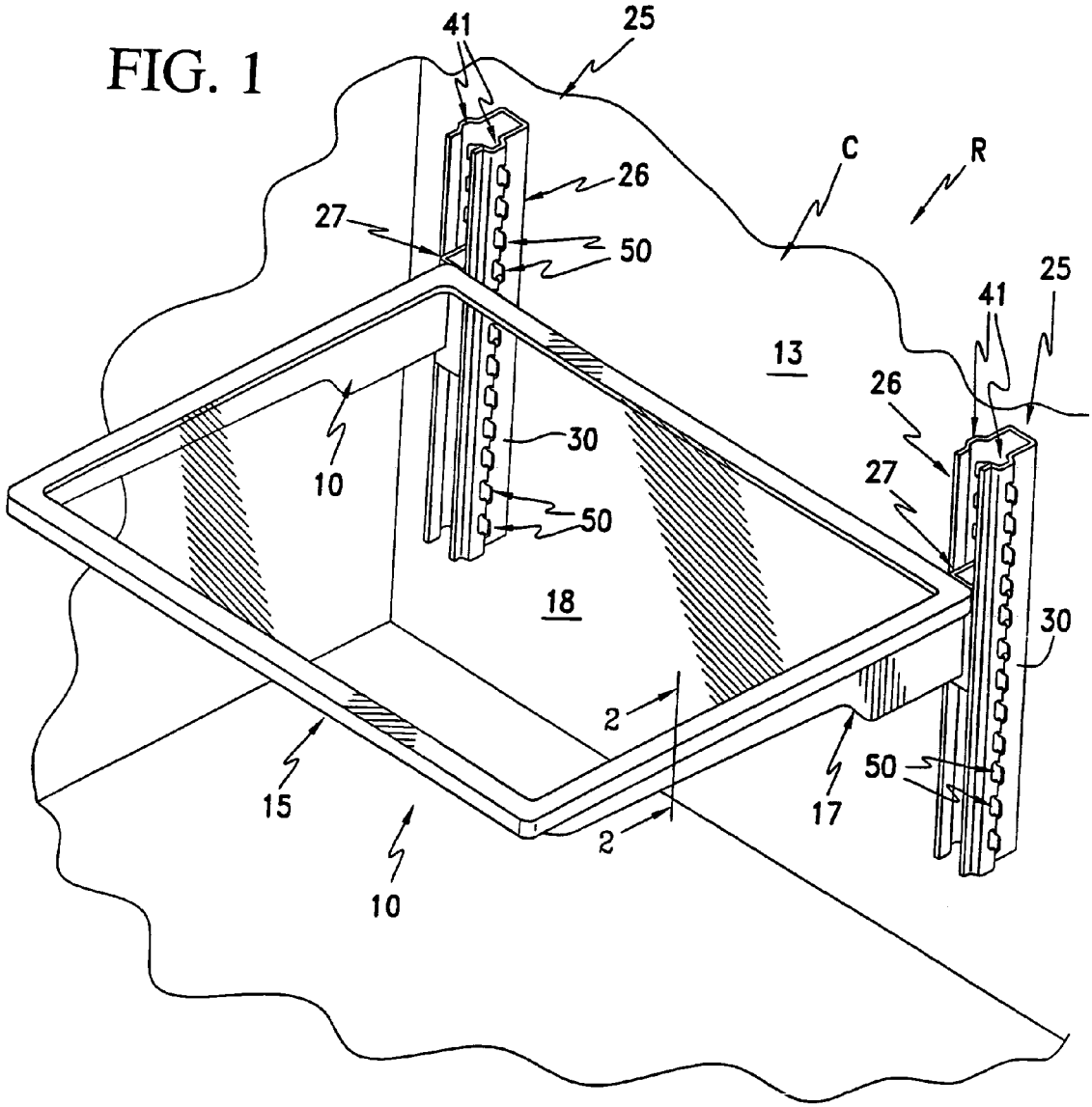
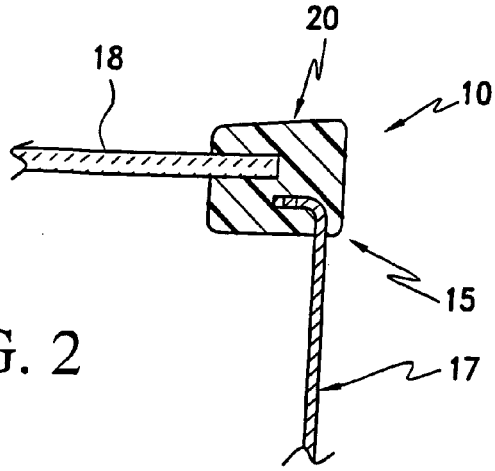
FIG. 2

FIG. 11
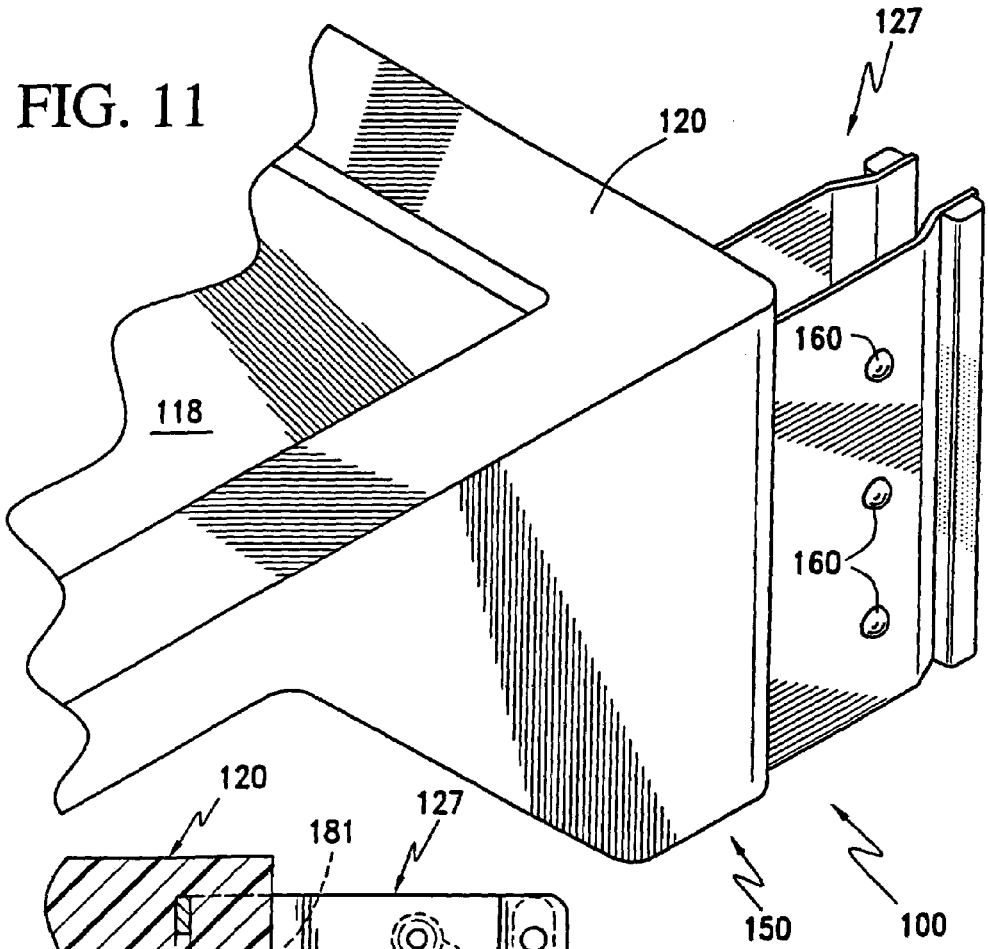
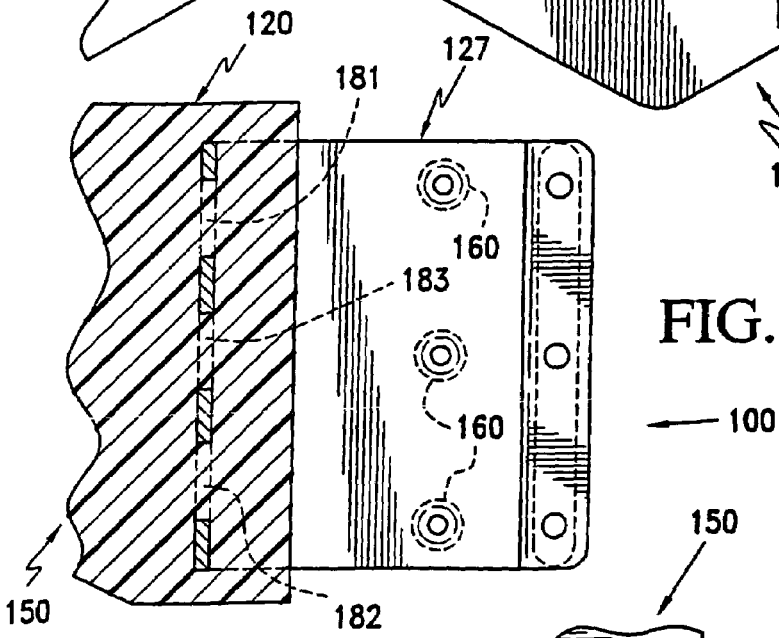
FIG. 13
FIG. 12
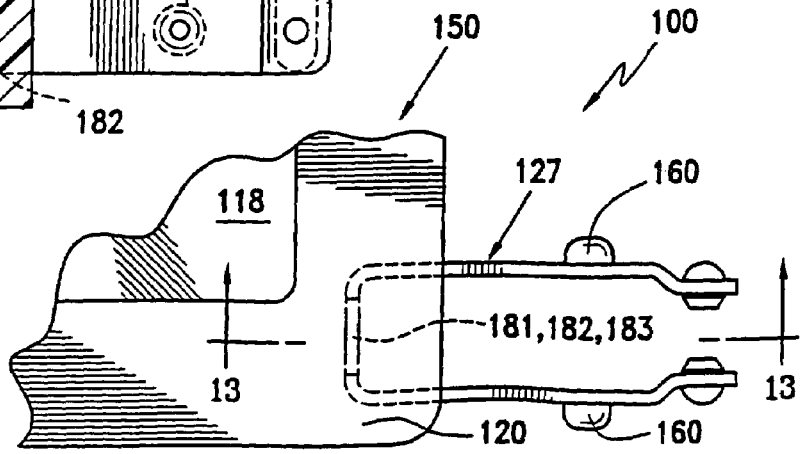

VERTICALLY ADJUSTABLE SHELVES AND REFRIGERATOR COMPARTMENT HOUSING THE SAME

CROSS-REFERENCE TO RELATED APPLICATION

This is a continuation-in-part application of application Ser. No. 10/355,136 filed Jan. 31, 2003 in the names of and Craig Bienick et al. entitled Refrigerator Compartment Housing Vertically Adjustable Shelves, and now U.S. Pat. No. 6,962,116.

BACKGROUND OF THE INVENTION

This invention relates to shelving particularly for refrigerators, but is equally adapted for utilization in a variety of different environments, such as furniture shelves, cabinet shelves, point-of-sale displays, and the like.

A conventional refrigerator shelf typically includes a substantially planar shelf member, and a pair of metal shelf brackets connected to the shelf member, preferably by an injection molded resinous peripheral encapsulation, rim or border. The support brackets typically include a pair of hooks which are received in pairs of slots carried by vertical shelf supports, channels or tracks secured to or forming an integral portion of a rear wall of a refrigerator compartment. The shelves can be step-adjusted along the vertical supports in a convention manner by hooking and unhooking the shelf brackets relative to the vertical supports or tracks. The latter is readily accomplished when the shelf is devoid of any products/articles. However, if relatively heavy products are supported upon the planar shelf member of the shelf, it is not uncommon for the weight and imbalance of the products to cause the shelf and the products thereon to dislodge and/or drop with attendant damage (breakage, spillage, etc.). At times a cantilevered shelf with articles/products thereon is partially unhooked from the vertical support rails of the refrigerator compartment and tilts or cants which causes the articles/products to slide off the shelf with resultant damage even though the shelf itself does not drop. Therefore, cantilevered shelves which are designed to be step-adjusted relative to shelf tracks or channels provided on the rear wall of a refrigerator are susceptible to damage during adjustment, along with the products/articles supported thereon.

SUMMARY OF THE INVENTION

Accordingly, the present invention provides a refrigerator shelf assembly defined in part by a conventional shelf, namely, a pair of metal support brackets, a planar shelf member, preferably made of clear tempered glass, and an injection molded encapsulation, border or rim unitizing the shelf brackets and the planar shelf member. However, the invention provides a novel adapter bracket utilized in pairs. Each adapter bracket is preferably constructed from metal and includes a first bracket member having front edges along each of which is a slideway or channel into which opens a plurality of vertically spaced slots. The rear of each first bracket member is conventionally secured to the rear wall of a refrigerator compartment. Each second bracket member includes a pair of oppositely projecting projections or supports which are vertically spaced from each other a distance corresponding to the slots in the first member. Moreover, the distance between the ends of the second member projections corresponds substantially to the same distance between the channels and is substantially equal to the maximum distance between support edges defined by the vertical slots of the second member. The latter dimensional relationships permit the shelf bracket first and second members, one of which carries the shelf, to be moved upwardly and downwardly in the slideways or channels without being fully disassembled therefrom thereby precluding inadvertent or accidental disassembly of the shelf from the pair of adapter brackets. The second members preferably include slots into which are hooked hooks of the shelf and remain so attached when the shelf is adjusted vertically upwardly or downwardly by sliding movement of the second members. In this fashion the shelf is never bodily removed from the adapter brackets and the first and second members of the adapter brackets are never bodily disconnected from each other unless done intentionally.

In further accordance with the invention, the projecting supports of the second members and the slideways and slots of the first member are so related that should the shelf be accidentally released when the second member projections are in the slideways, the weight of the cantilevered shelf, with or without products/articles thereon, tilts or cants the cantilevered shelf forwardly and downwardly which automatically introduces a lowermost of the second member projections into associated slots of the first member which bottom against support edges of the slots and automatically lock the cantilevered shelf in the position of a slight forward tilt. In this manner the entire shelf and the articles/products supported thereon will not drop and most, if not all, products/articles will be retained upon the glass shelf member thereof.

The novel shelf assembly and the pair of shelf adapter brackets associated therewith thereby effect limited vertical sliding movement to space shelves different vertical distances from each other but permit the latter to be accomplished without bodily or entirely disconnecting the shelf from the adapter brackets and the adapter brackets from the refrigerator compartment. The latter, with the automatic locking feature latter described, virtually eliminates inadvertent/accidental shelf, shelf assembly, product and/or article breakage or damage during vertical shelf adjustment.

Another object of this invention is a novel shelf assembly which can provide increment vertical adjustment in a conventional refrigerator compartment absent inadvertent, accidental or undesired downward shelf movement during vertical adjustment when utilized with standard refrigerator compartment trackways lacking structure to provide the latter advantage. The shelf assembly is defined by a pair of vertical trackways and the shelf associated therewith which can be incrementally vertically adjusted. The vertical trackways further include means for stopping undesired downward vertical travel of the shelf relative to the trackway after the unlatching thereof. However, each of the vertical trackways includes means for securing the vertical trackways to slots or openings in conventional vertical trackways of a refrigerator compartment thereby providing selective vertical shelf adjustment absent the shelf and its products dropping from the vertical trackways with attendant consequences, i.e., product breakage, spillage, etc.

In further accordance with this invention, each vertical trackway preferably includes one or more hooks for hooking the same into the slots of the conventional refrigerator compartment trackways, and the hooks are preferably formed from the material of a bight wall of each vertical trackway which is of a generally U-shaped transverse cross-sectional configuration.

A further object of this invention is to provide a novel shelf assembly as immediately heretofore set forth wherein the shelf includes a shelf panel and opposite shelf brackets, and the shelf brackets include means for intimately slidably engaging side walls of the vertical trackways to thereby reduce sidewise shelf movement.

A further object of this invention is to provide a novel shelf assembly as immediately heretofore set forth wherein the shelf includes a shelf panel and opposite shelf brackets, and the shelf brackets include means projecting rearwardly from each shelf bracket for engaging stops in the vertical trackways during undesired vertical downward travel of the shelf.

Another object of this invention is to provide a novel shelf assembly in which each shelf bracket has an opening and at least one pin in the opening having end portions projecting in opposite directions, the pin includes a pair of collars larger than the opening and sandwiching the opening therebetween, and at least one of the collars is formed of material of its associated pin end portions swaged from a size corresponding substantially to the opening to a size larger than the opening to thereby retain the pin in the opening.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a refrigerator, a refrigerator compartment thereof and a novel shelf assembly of the invention defined by a shelf having an injection molded encapsulation or rim unitizing a tempered glass shelf member to a pair of metal shelf support brackets, and a pair of shelf adapter brackets each defined by first and second bracket members, each of the first bracket members being secured to a rear wall of the refrigerator compartment and having opposing slideways and a plurality of vertically spaced slots therein, and a second bracket member having oppositely directed projecting supports received in the slots and additionally having slits or slots receiving hooks of the metal shelf support brackets.

FIG. 2 is an enlarged fragmentary cross-sectional view taken generally along line 2-2 of FIG. 1, and illustrates the injection molded rim encapsulating and unitizing a peripheral edge of the glass shelf member and an upper edge of one of the metal shelf support brackets.

FIG. 11 is a top perspective view of another shelf adapter bracket of the present invention and illustrates one of the second shelf bracket members of FIG. 1 integrally unitized to a shelf by an injection molded encapsulation or rim at a reinforced corner thereof.

FIG. 12 is a fragmentary top plan view looking downwardly in FIG. 11, and illustrates oppositely directed projecting supports of the second shelf bracket member.

FIG. 13 is an enlarged fragmentary cross-sectional view taken generally along line 13-13, and illustrates the manner in which the shelf bracket member is unitized to the shelf by the injection molded encapsulation or rim at the corner thereof.

DESCRIPTION OF THE PREFERRED EMBODIMENTS

Figure 3:
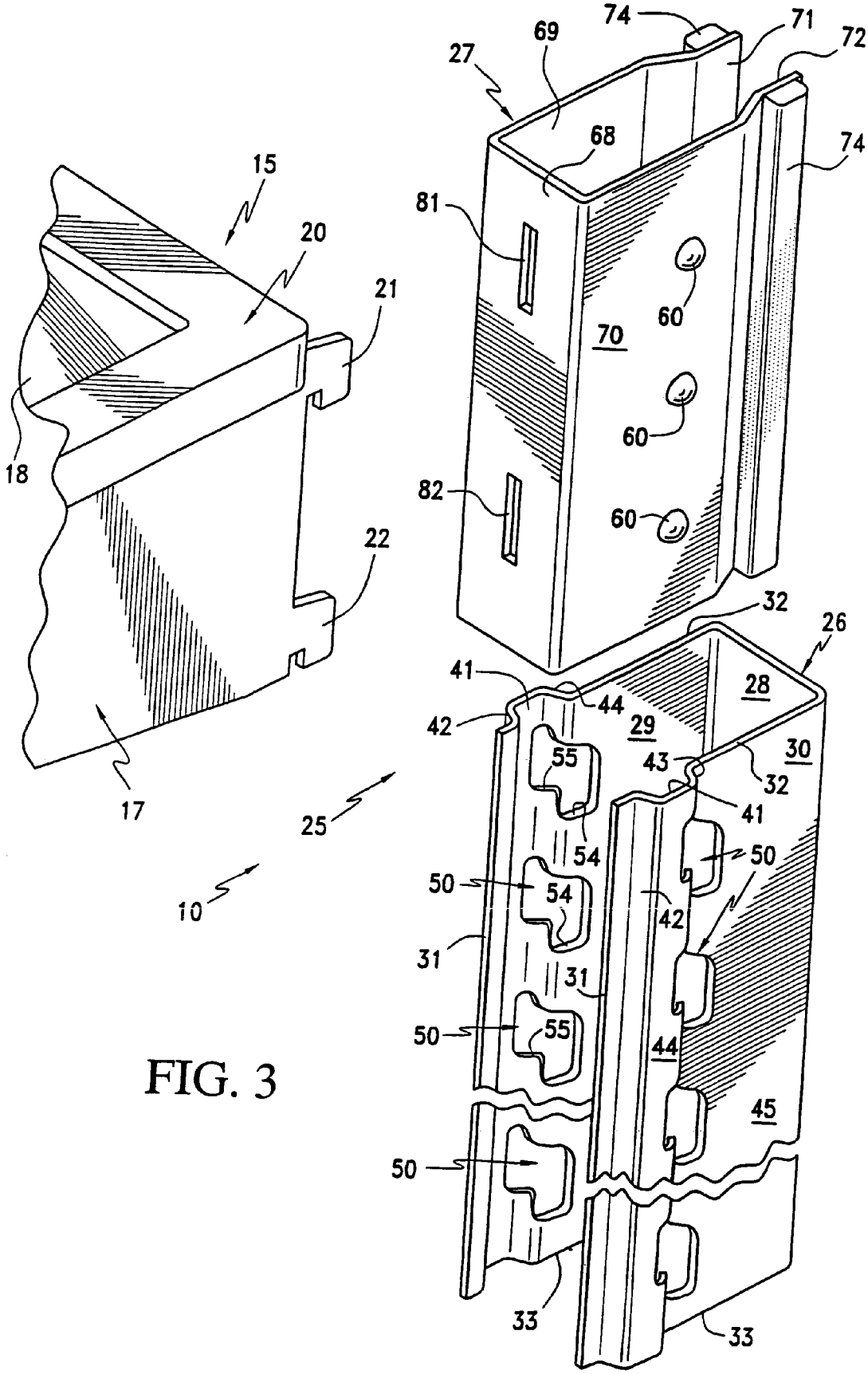
FIG. 3 is a fragmentary exploded view of one of the shelf adapter brackets, and illustrates details of the slideways and slots of the first shelf bracket member, oppositely directed projecting supports and slits of the second shelf bracket member and hooks of the shelf.

A novel refrigerator shelf assembly constructed in accordance with the present invention is generally designated by the reference numeral 10, and is illustrated in FIG. 1 in association with a cabinet or compartment C of a refrigerator R.

The shelf assembly 10 includes a shelf 15 defined by opposite substantially parallel metal shelf brackets 16, 17 unitized to a peripheral edge (unnumbered) of a shelf member 18 of tempered glass by an injection molded encapsulation, rim or border 20 (FIG. 2) formed in accordance with the method disclosed in U.S. Pat. No. 5,362,149 granted on Nov. 8, 1994 to Bird et al., the totality of which is incorporated hereat by reference. Each of the metal support brackets 16, 17 includes conventional downwardly directed hooks 21, 22 which normally engage in vertically disposed parallel shelf tracks in a conventional refrigerator compartment, as is fully disclosed in the latter-identified patent. Such conventional shelves 10 can be hooked to, completely unhooked from and re-hooked to the slots of the shelf tracks to effect step-wise vertical adjustments of the shelves relative to other shelves and/or top and bottom walls of an associated refrigerator compartment. However, a disadvantage of such total disconnection noted earlier herein between conventional shelf hooks and conventional vertical shelf tracks can result in advertent or accidental shelf and/or product droppage and result in damage or breakage. The latter is precluded by the novel refrigerator shelf assembly 10 of the present invention.

Figure 4:
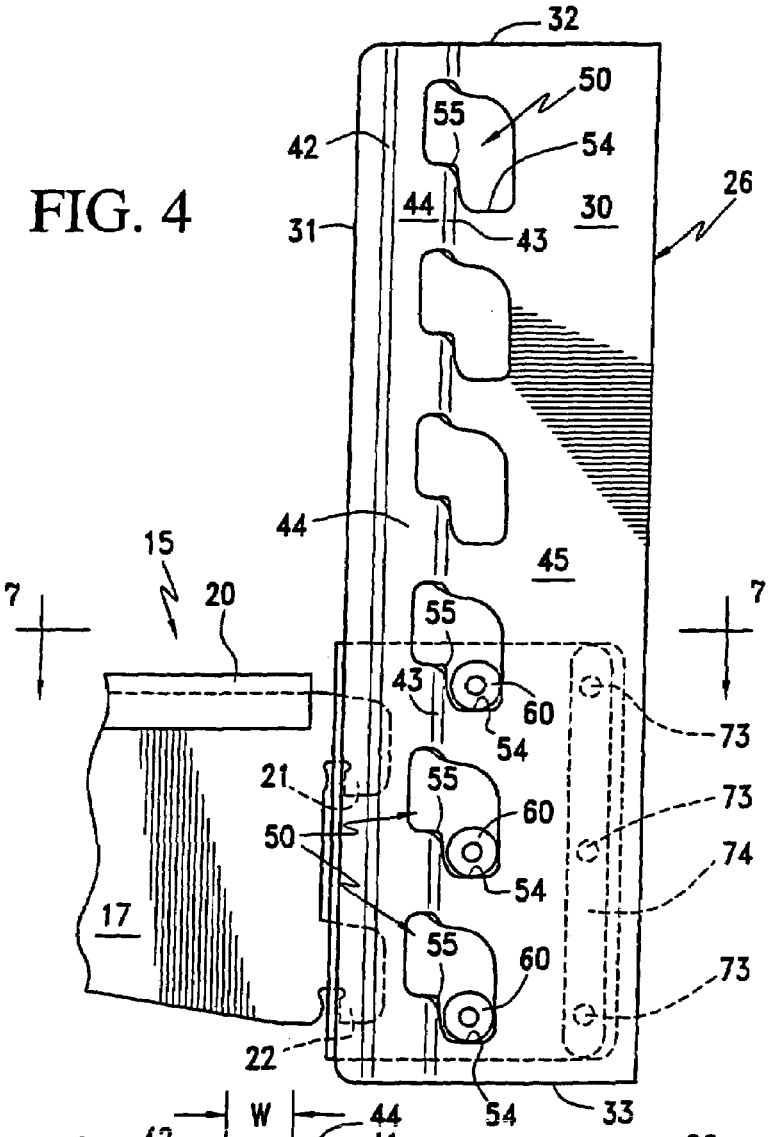
FIG. 4 is a fragmentary side elevational view of one of the shelf adapter brackets, and illustrates the manner in which the oppositely directed projections of the second shelf bracket member are seated in the slots of the first shelf bracket member and hooks of the shelf support brackets are received in slits of the second shelf bracket member.
Figure 5:
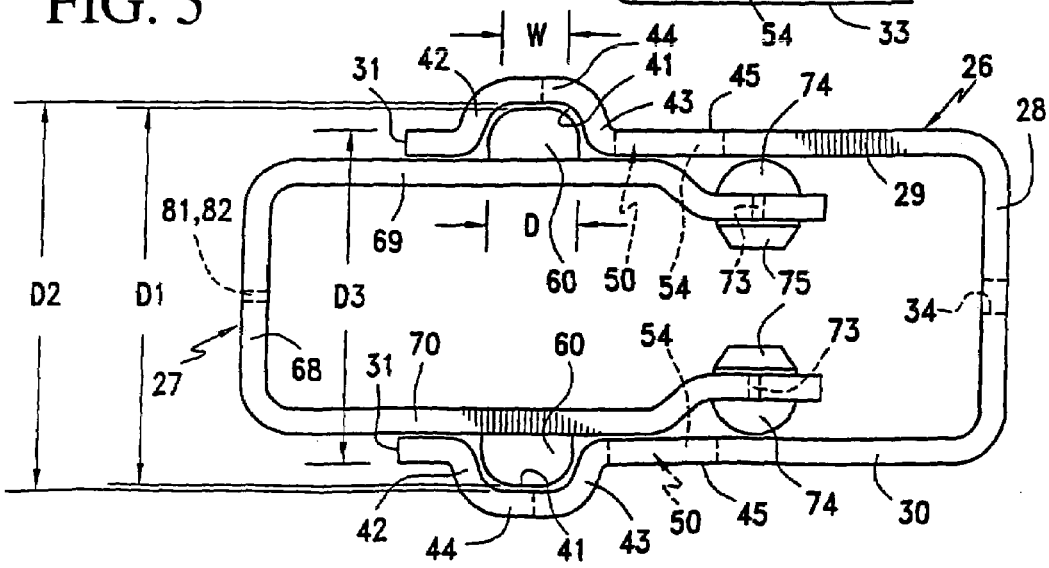
FIG. 5 is an enlarged top plan view of each shelf adapter bracket of FIG. 1, and illustrates the manner in which the projecting supports of the second shelf bracket member slide in the slideways of the first shelf bracket member to effect vertical sliding adjustment therebetween.

The shelf assembly 10 further includes a pair 25, 25 (FIG. 1) of identical shelf adapter brackets, each defined by a first shelf bracket member 26 and a second shelf bracket member 27 (FIGS. 3-5). Each first shelf bracket member 26 of the pair 25, 25 of shelf bracket adapters is of a generally U-shaped transverse cross section (FIGS. 5 and 7) and is preferably constructed of relatively rigid metallic sheet material stamped, blanked and formed to the specific configuration best illustrated in FIG. 3 of the drawings. Each U-shaped first bracket member includes a bight wall or bight portion 28 and opposite legs or leg portions 29, 30. Each leg 29, 30 includes a relatively straight front edge or edge portion 31, a top edge or edge portion 32 and a bottom edge or edge portion 33. The bight portion or wall 28 has a plurality of openings 34 (FIGS. 5, 6 and 7) for securing each of the first bracket members 26, 26 to a rear wall 13 of the refrigerator compartment C, as is readily apparent in FIG. 1 of the drawings.

Each of the legs 29, 30 of each of the first shelf bracket members 26, 26 is provided with a vertical slideway or channel 41 immediately adjacent each front edge 31 and substantially parallel thereto. Each slideway 41 is of a generally U-shaped transverse cross section (FIGS. 3, 5 and 7) and is defined by a first leg or leg portion 42 most adjacent each front edge 31, a second leg or leg portion 43 and a bight portion 44 therebetween. The legs or leg portions 42, 43 are in diverging relationship to each other in a direction away from the bight portion 44. Each slideway or channel 41 includes a narrowest transverse width W which increases in the opening direction of the slideways 41, 41. Each leg portion 43 also blends with a medial portion 45 (FIGS. 3-7) of each of the legs 29, 30.

A plurality of identical vertically spaced support means 50 in the form of slots or openings 50 are formed along the length of the medial portion 45 of each of the legs 29, 30 between the upper edge 32 and the lower edge 33 thereof. Each slot 50 includes a front vertical edge 51, a rear vertical edge 52 and a slightly curved top edge 53. The edges 51, 52 are substantially parallel to each other and are parallel to the front edge 31 of the associated legs 29, 30. A lower edge or ledge of each slot 50 includes a lowermost substantially horizontally disposed edge or ledge 54 defining means for supporting projecting supports or projections 60 of each of the second bracket members 27, as will be described more fully hereinafter. A curved transition edge or ledge 55 extends from each edge 51 to each edge 54 beginning at a point midway in the bight portion 44 of each slideway 41, continuing along the ledge portion 43 and ending at a merge point (unnumbered) with the supporting ledge or edge 54 (FIGS. 3-7).

The purpose and function of the transition edges or ledges 55 of the legs 29, 30 of each of the first shelf bracket members 26 is to permit the projecting supports, projections or pins 60 of the second shelf bracket members 27 ready entry from the associated slideways 41, 41 toward and downwardly upon the support edges or ledges 54 of the slots 50 and the like ready removal thereof in an opposite direction for purposes of assembling or vertically slidably adjusting the shelf 15 relative to the first bracket members 26 by sliding the second bracket members 27 vertically relative thereto.

Figure 7:
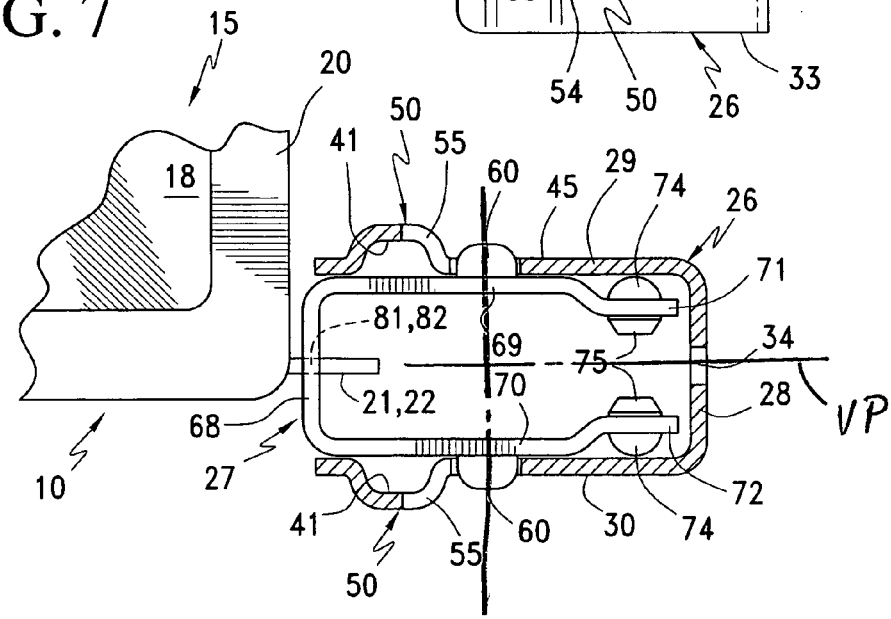
FIG. 7 is a fragmentary cross-sectional view taken generally along line 7-7 of FIG. 4, and illustrates one of the shelf adapter brackets in the adjusted and locked position thereof.

As is best illustrated in FIGS. 3 through 5 of the drawings, the second shelf bracket member 27 of each of the pairs 25, 25 of adapter brackets is also of a generally U-shaped transverse cross-sectional configuration, and is preferably also constructed of relatively rigid sheet metal material blanked, stamped and formed to the configuration best illustrated in FIGS. 3 and 5 of the drawings. Each second shelf bracket member 27 includes a bight wall 68 and oppositely substantially parallel legs 69, 70 which converge toward each other and terminating in substantially parallel end edges or edge portions 71, 72, respectively. The end edges 71, 72 each have a plurality of vertically spaced openings 73 (FIGS. 4 and 5) through which injected polymeric/copolymeric plastic material can pass during the formation of slide members 74 (FIG. 3) on outer surfaces (unnumbered) of the terminal end portion 71, 72 and enlarged heads 75 (FIG. 5) on inboard surfaces (unnumbered) of the terminal edges 71, 72. Slots 81, 82 (FIGS. 3 and 5) are formed in the bight wall 86 of each second shelf bracket member 27 for receipt therein of the hooks 21, 22 of the shelf 15. The pins or projections 60 have a maximum diameter D (FIG. 5) increasing from the narrowest transverse width W of the slideways 41, 41 to the maximum width thereof to permit relative vertical sliding movement therebetween during which the glide members 74, 74 engage inner surfaces (unnumbered) of the legs 29, 30 of the first bracket members 26, as is best illustrated in FIGS. 5 and 7 of the drawings.

As is best illustrated in FIG. 5 of the drawings, the oppositely projecting pins 60, 60 carried by each second shelf bracket member 27 are spaced from each other a maximum effective distance D1 which is slightly less than an effective distance D2 measured between the bight portions 44 of the slideways 41. Because of the slight difference in the distances D1, D2, the projecting pins or projecting supports 60 move readily easily vertically upwardly and downwardly within the slideways 41. Therefore, during initial installation after each of the first bracket members 26, 26 has been secured to the rear wall 13 of the refrigerator compartment C with the slots 50, 50 thereof in horizontal alignment, the pins 60 can be introduced into the slideways 41 from above or below. This can be done by first hooking the hooks 21, 22 into the respective slots 81, 82 of the second shelf bracket members 27 and thereafter simultaneously introducing the latter from the bottom or from the top into the first shelf bracket members 26, 26. Alternately, the shelf 15 need not be connected through its hooks 21, 22 to the slots 81, 82 of the second shelf bracket members 27 but instead the latter can be individually or simultaneously introduced into the first bracket members 26 via the slideways 41 and when horizontally aligned, the second shelf bracket members 27 are simply pushed inwardly in a direction toward the bight walls 28 of the first shelf bracket members 26. As the second shelf bracket members 26 are pushed inwardly, the projecting pins 60 thereof engage and are guided downwardly by the upper edges 53 and/or by the lower edges 55 of a pair of the slots 50. Since the slideways 41, 41 of each of the first bracket members 26, 26 oppose each other, the leg portions 43 thereof are in converging relationship to each other in a direction away from the front edges 31, 31 of the legs 29, 30 and toward the bight wall 28 (FIG. 5). Therefore, during the inward movement of the supporting pins 60 from within the slideways 41 (FIG. 5), the pins 60 move along the converging edges or ledges 55 of the converging walls 43, 43 (FIG. 5) progressively inward from the outermost distance D2, measured across the bight walls 44, 44 of the slideways 41, 41 to a distance D3 (FIG. 5) which is the maximum distance between the horizontally adjacent supporting edges 54. In this manner the transition edges 55, 55 (FIG. 7) of horizontally adjacent slots 50, 50 in the legs 29, 30 of each of the first shelf bracket members 26, 26 contact and guide the associated pins 60, 60 from the slideways 41, 41 toward and upon the supporting edges 54 (FIGS. 4 and 7) and conversely away from the supporting edges 54 and into the slideways 41 for disassembly purposes.

It is to be particularly noted that during any of the vertical adjustment just described of the shelf 15 when attached to the second shelf bracket members 27, 27, and specifically during the movement of the latter along the slots 50 and the slideways 41, there is no total or complete disassembly of the shelf 15 relative to the second shelf bracket members 27 or any total disassembly of the second shelf bracket members 27 relative to the first shelf bracket members 26. Therefore, during vertical adjustment of the shelf 15, when connected to the second shelf bracket members 27, it is extremely unlikely that the shelf 15, with or without products/articles thereon, will be inadvertently dropped or tilted because during any such adjusting movement the projecting pins 60, 60 are at all times in contact with portions of the first shelf bracket members 26, be it through the slots 50, 50 or the slideways 41, 41 thereof. It is only upon moving the projecting pins 60 upwardly or downwardly along their associated slideways 41 that the shelf 15 can accidentally drop substantially vertically if released, and only upon the removal of all three projecting pins 60 from each slideway 41 could the shelf 15 drop to the bottom of the compartment C, though the latter is virtually impossible for reasons explained immediately hereinafter.

Figure 6:
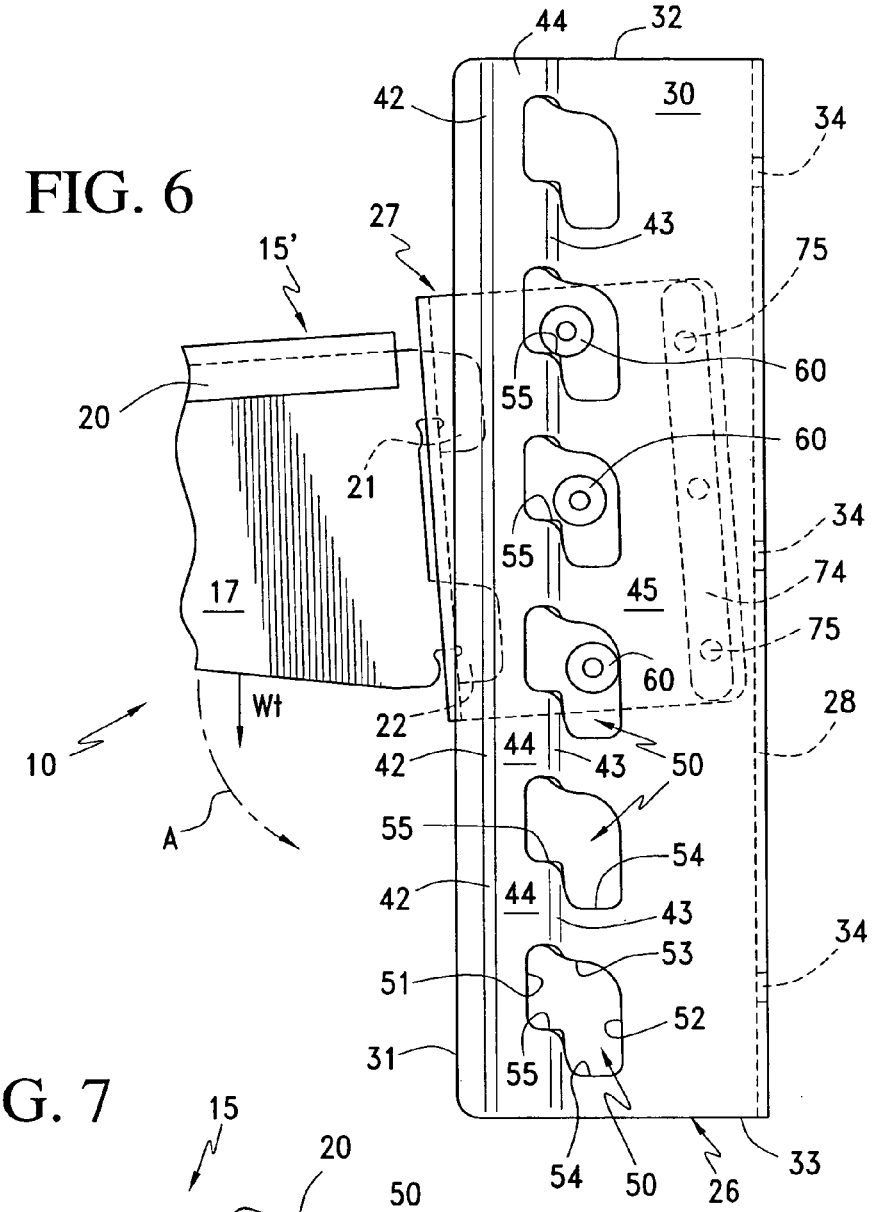
FIG. 6 is a side elevational view of the shelf adapter bracket of FIG. 4, and illustrates the manner in which the shelf will automatically lock in a slightly inclined or canted position if inadvertently or accidentally released or dropped when the projecting supports of the second shelf bracket member are in the slideways of first shelf bracket member.

Reference is made to FIG. 6 of the drawings which illustrates the position of the shelf 15' after it has been introduced from above by inserting each second shelf bracket member 27, 27 into an associated first bracket member 26, 26 with the projecting pins 60 disposed in the slideways 41. With the uppermost pins 60, 60 of each second shelf bracket member 27 are immediately adjacent the upper edges 32 of each first shelf bracket members 26, it is assumed that the shelf 15' is accidentally released/dropped. Since the shelf 15' is cantilevered, even absent products or articles supported thereon, its weight Wt (FIG. 6) will effect downward movement and vertical pivoting and/or tilting movement. In other words if the shelf 15' were released from the uppermost assumed position, it would begin to fall vertically because of gravity acting upon its weight Wt, but since the shelf 15' is cantilevered, it will also pivot, tilt or cant in a counterclockwise direction, as is indicated by the curved line of travel A associated therewith in FIG. 6 bringing the uppermost projecting pins 60 into bearing engagement with the front leg portions 42 of the slideways 41 and the lowermost projecting supports or pins 60 into bearing engagement with the rear leg portions 43 at the slideways 41. If the slots 50 did not project into the bight portions 44 of the slideways 41, the shelf 15' would most assuredly continue a downward slide while being slightly cocked or tilted with the uppermost and lowermost projecting supports 60, 60 bearing against the respective front and rear leg portions 42, 43 of the slideways 41 until dropping out the bottom thereof. However, since the slots 50 include the ledge or edge portions 55 (FIGS. 4 and 5) which begin within the medial portion 44 of each slideway 41, the lowermost projecting supports 60 (FIG. 6) eventually reach the slots 50, devoid of the inner leg portions 43, which allows the projecting supports 60 to progressively enter horizontally aligns slots 50 guided by the transition edges 55, as is readily visualized in FIG. 6, until eventually fully overlying the transition edges 55 thereof which guide the lowermost projecting supports 60 toward and upon the horizontal supporting edges 54. Thus, the shelf 15' can be adjusted along the slideways 41 to any one of a number of vertically desired positions of adjustment absent fear of disengagement of the second shelf bracket members 27 from the first shelf bracket members 26. The latter function is extremely important because even under a worse case scenario, the shelf 15' will not drop from the first bracket members 26 and will tilt substantially no worse than that illustrated in FIG. 6 of the drawings. Even should the latter occur while articles or products are being supported upon the shelf 15', a person most likely could prevent the articles/products from falling because both hands could be utilized for the latter purpose, as opposed to being used to essentially simultaneously catch and/or hold the shelf 15' and the articles/products supported thereupon.

Figure 9:
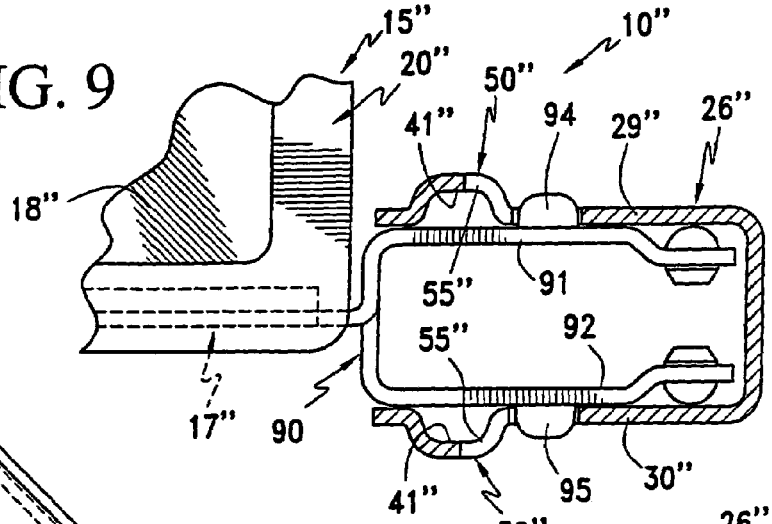
FIG. 9 is a fragmentary cross-sectional view taken generally along line 9-9 of FIG. 10, and illustrates the shelf bracket having a glass panel member unitized thereto by an injection molded rim or encapsulation and the oppositely directed supporting projections thereof seated in slots of an associated first shelf bracket member conventionally secured to a wall of the refrigerator compartment.
Figure 8:
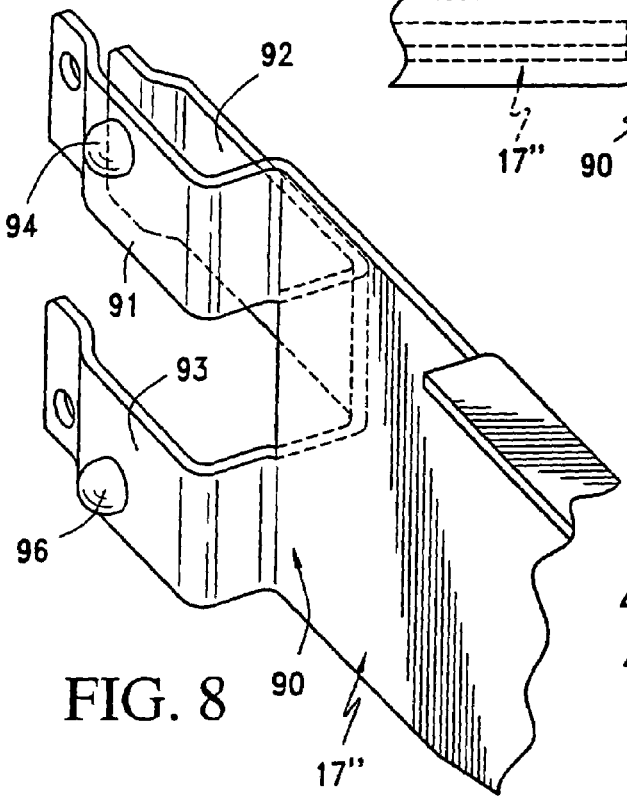
FIG. 8 is fragmentary perspective view of a shelf bracket constructed in accordance with this invention, and illustrates as an integral part thereof a rear member in the form of a second shelf bracket member carrying oppositely directed supporting projections.
Figure 10:
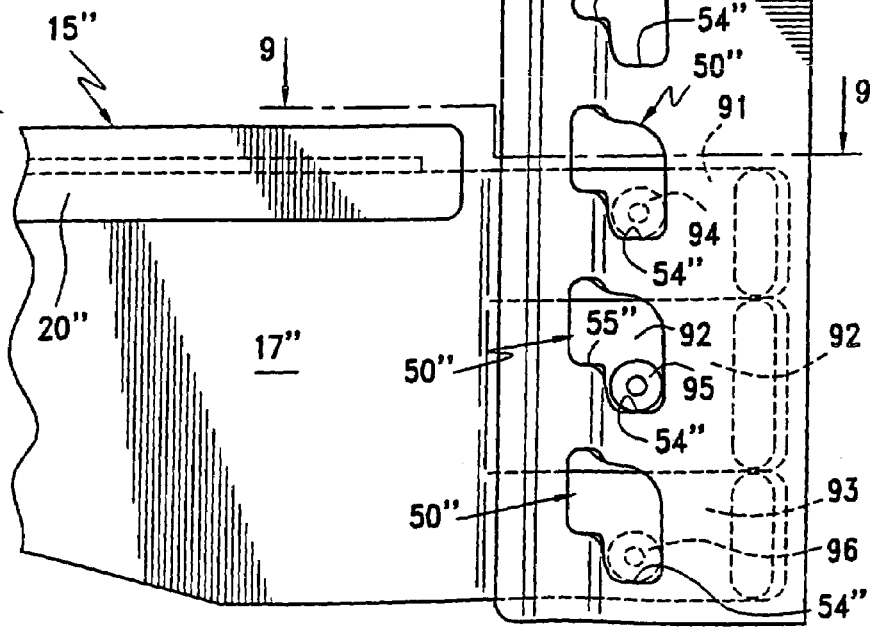
FIG. 10 is a fragmentary side elevational view of the shelf and shelf adapter bracket of FIG. 9, and illustrates the interlocked relationship between the first and second shelf bracket members thereof to achieve desired vertical adjustment.

Another novel refrigerator shelf assembly constructed in accordance with the present invention is illustrated in FIGS. 8 through 10 of the drawings and is generally designated by the reference numeral 10". All the structure and components of the refrigerator shelf assembly 10" which are structurally identical to or equivalent to the refrigerator shelf assembly 10 of FIGS. 1 through 5 of the drawings bear the same reference numerals and reference characters but are double primed.

The refrigerator shelf assembly 10" includes a shelf 15" formed by two metal shelf supporting brackets of which only the shelf supporting bracket 17" is illustrated. A shelf member 18" of tempered glass and an injection molded encapsulation, rim or border 20" unitize the latter components which can be hooked, re-hooked and vertically adjusted relative to a first bracket member 26". Therefore, the overall shelf assembly 10" is identical to the shelf assembly 10 except that in lieu of the separate second shelf bracket member 27, the shelf bracket support 17" and the opposite equivalent unillustrated metal shelf bracket support, are each provided with a second shelf bracket member 90 which is an integral part of the shelf supporting bracket 17" (FIG. 8). The shelf bracket 17" is slit longitudinally, blanked, stamped and formed to define an upper leg 91, a medial leg 92, and a lower leg 93. The upper and lower legs 91, 93, respectively, are offset to one side of a vertical plane of the shelf bracket 17" while the medial or central leg 92 is offset an equal amount to an opposite side of a vertical plane through the shelf bracket 17" resulting in the generally U-shaped configuration when viewed from above or below (FIG. 9). The legs 91 through 93 include projecting supports or projecting pins 94 through 96, respectively. The projecting supports 94, 96 project away from and axially opposite to the direction of projection of the projecting support 95, as is most apparent from FIG. 9. The vertical spacing between the projecting supports 94, 95; 95, 96 corresponds to the vertical spacing between the slots 50" of the first shelf bracket member 26".

As in the case of the shelf 15, the shelf 15" can be inserted into the first shelf bracket member 26" from above or below by simply introducing the projecting supports 94 through 96 in the associated slideways 41", 41" (FIG. 9) and positioning the projecting supports 94 through 96 in three desired slots 50", as is illustrated in FIG. 10. Structurally and functionally the shelf assemblies 10, 10' are virtually identical except for the fact that by constructing the shelf support 17" and the second shelf bracket member 90 as a single one-piece component from a single piece of metallic material, the overall expense of manufacture of the shelf assembly 10" is appreciably lessened as compared to that of the shelf assembly 10.

Another shelf assembly constructed in accordance with this invention is illustrated in FIGS. 11 through 13 of the drawings and is generally designated by the reference numeral 100. The shelf assembly 100 is similar in structure and is substantially identical in function to the shelf assembly 10 and at each of two rear corners (unnumbered) of an injection molded encapsulation, border or rim 120, there is a second shelf bracket member 127 which is substantially identical to the second shelf bracket member 27 (FIG. 3) and functions in the manner heretofore described with respect to an associated one of a pair of first shelf bracket members 26 to adjust the shelf 150 vertically in a refrigerator compartment. The shelf assembly 100 differs from the shelf assembly 10 in that the shelf 150 excludes metallic shelf brackets corresponding to the shelf brackets 16, 17, and in lieu thereof the injection molded encapsulation, border or rim 120 integrally unitizes or unites a shelf member 118 of tempered glass to the second shelf bracket member 127 at each of the two rear corners of the rim 120 during the injection molding of the rim 120 which causes the injection molded polymeric/copolymeric material thereof to fuse across a plurality of slots 181 through 183 (FIG. 13). With one of the second shelf bracket members 127 at each corner of the shelf 150, oppositely directed projections 160 thereof function with respect to slideways 41 and slots 50 of associated first shelf bracket members 26 in the manner heretofore described relative to the shelf assembly 10.

Figure 14:
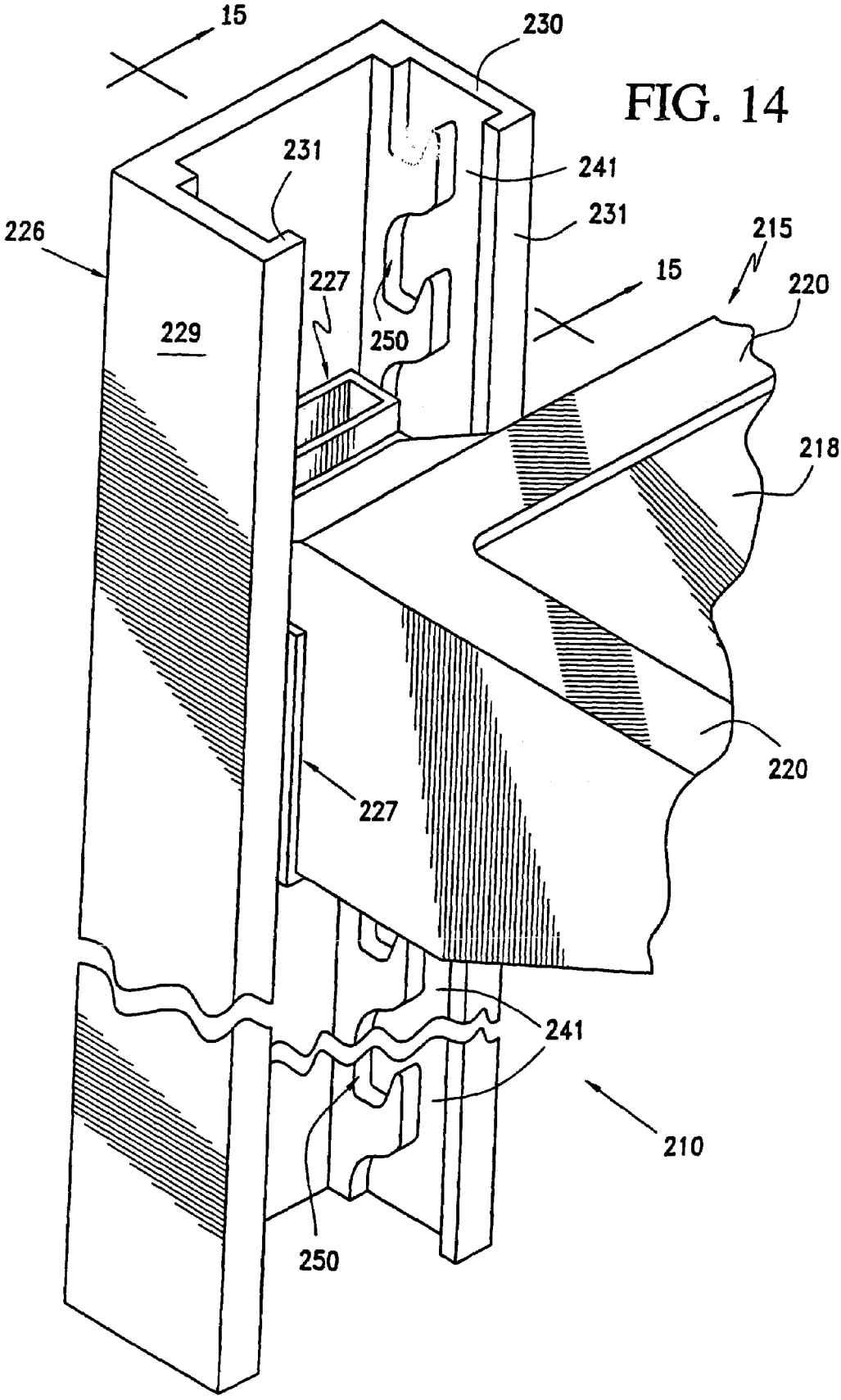
FIG. 14 is an enlarged fragmentary perspective view of another shelf adapter bracket, and illustrates a first shelf bracket member having opposing channels or slideways and vertically spaced slots and a second shelf bracket member locked thereto and supporting a shelf.
Figure 15:
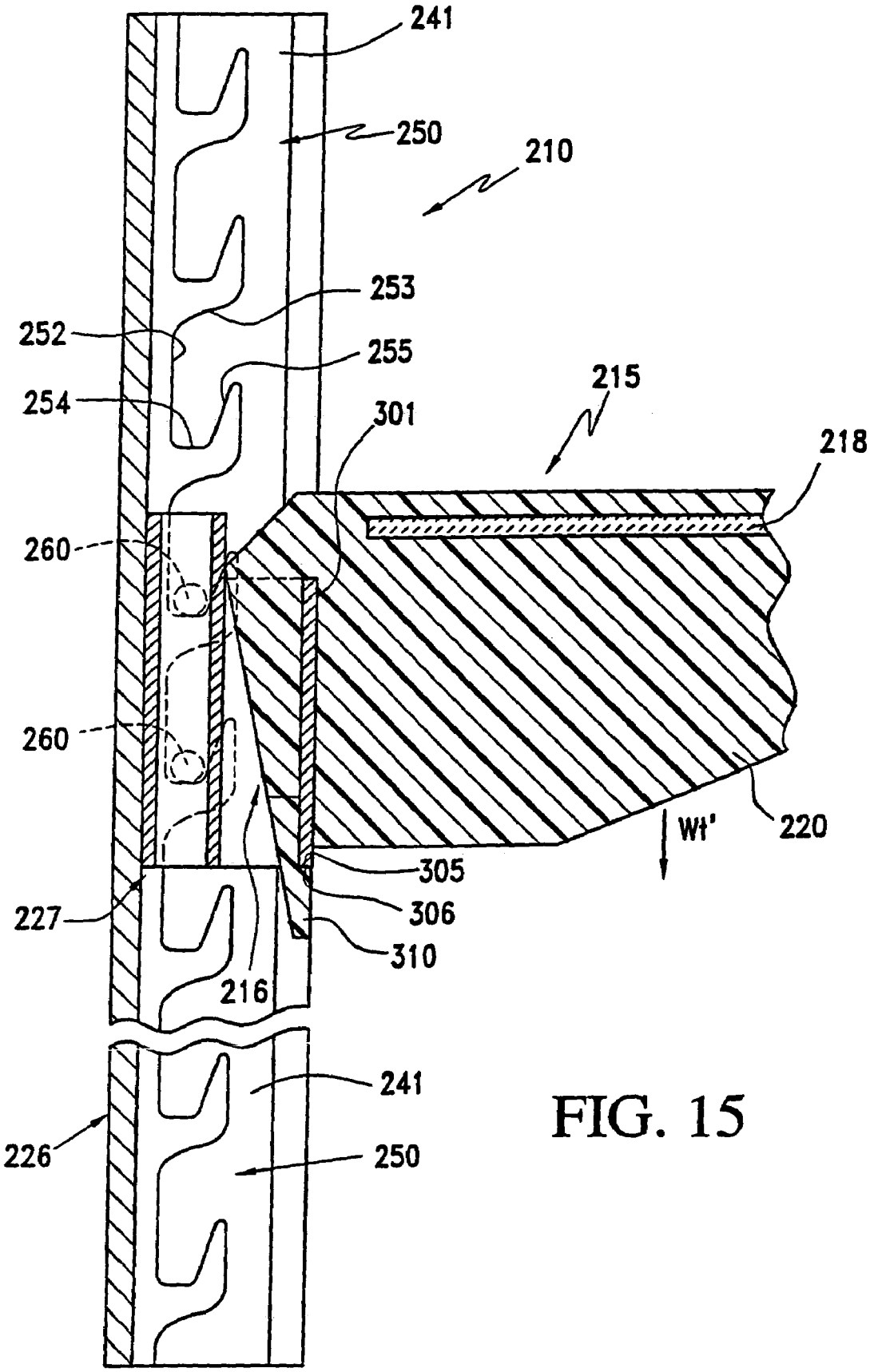
FIG. 15 is a vertical cross-sectional view taken generally along line 15-15 of FIG. 14, and illustrates the interlocked relationship between the first and second shelf bracket members, and integral hooks of a shelf carried by one of the second shelf bracket members.
Figure 16:
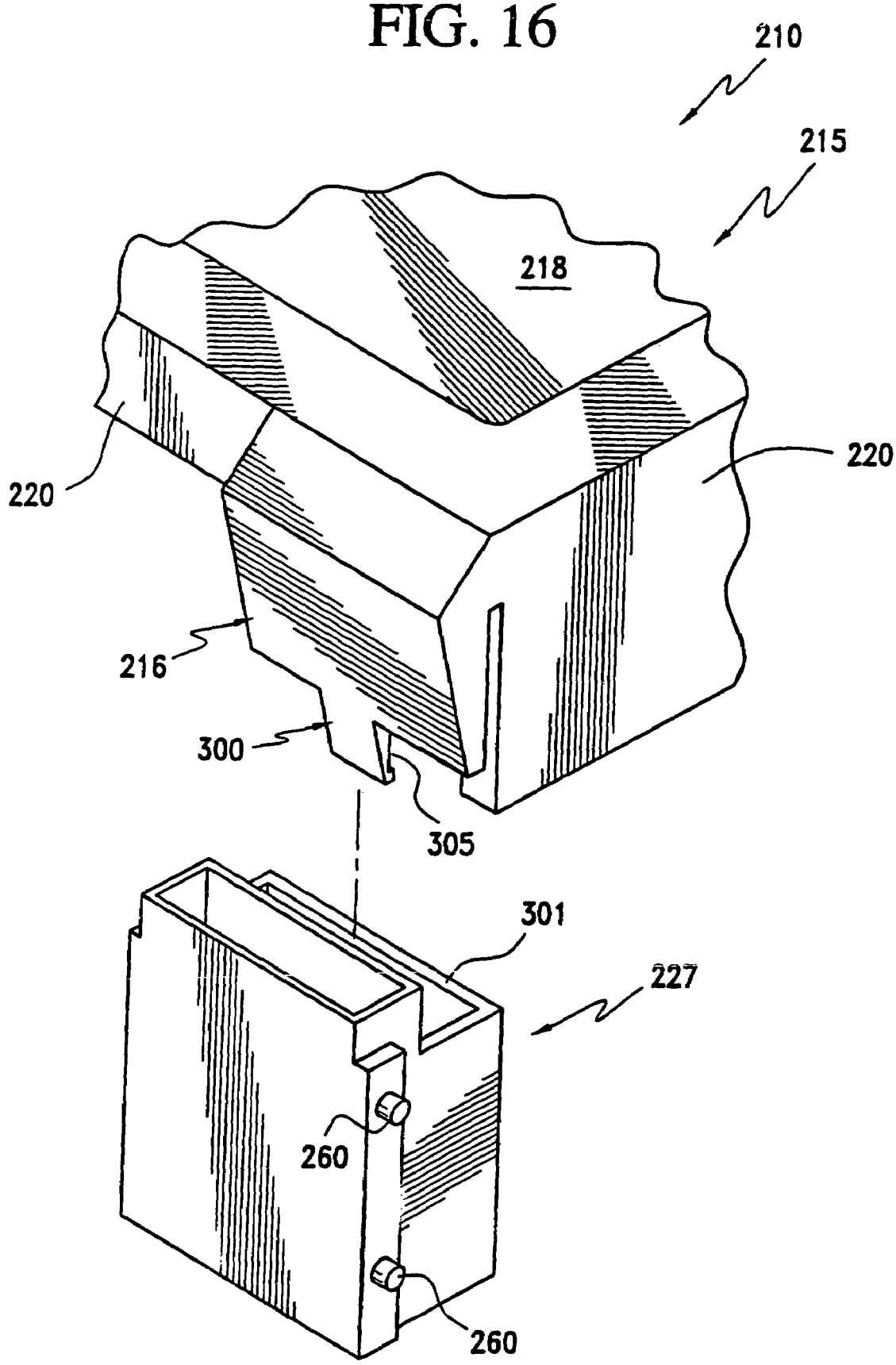
FIG. 16 is a fragmentary exploded view of the shelf and second shelf bracket member of FIGS. 14 and 15, and illustrates details thereof.

A final novel refrigerator shelf assembly constructed in accordance with the invention is illustrated in FIGS. 14 through 16 of the drawings and is generally designated by the reference numeral 210. Structure of the shelf assembly 210 which is structurally or functionally equivalent to the shelf assembly 10 is identified by identical reference numerals preceded by 200, such as a shelf 215 defined by a shelf member 218 of tempered glass which is encapsulated along a peripheral edge (unnumbered) thereof by an injection molded encapsulation, rim or border 220 which at opposite rear corners (unnumbered) includes downwardly directed relatively rigid integral hooks 216, each of which includes a centrally located, downwardly projecting, thinner flexible latching or locking tab 300 having a locking ledge 305 and a finger/thumb tab 310 (FIG. 15). Each hook 216 hooks over and behind a front wall 301 of a second shelf bracket member 227 constructed from molded polymeric/copolymeric synthetic plastic material. Each of the two second shelf bracket members 227, of which only one is illustrated, is adapted for introduction into and can be vertically adjusted relative to a first shelf bracket member 226 (FIG. 14) also constructed from synthetic polymeric/copolymeric plastic material. Each second shelf bracket member 227 includes a pair of vertically spaced oppositely directed projecting supports or supporting pins 260 (FIGS. 15 and 16) which slide in associated slideways 241 (FIGS. 14 and 15) which open toward each other in opposite legs 229, 230 (FIG. 14) of each first shelf bracket member 226. Each leg 229, 230 includes a front edge or front flange 231 with the flanges 231, 231 being in opposing relationship to each other and in part each defining one of the slideways 241 which extend the entire vertical length of the first shelf bracket member 226. Each of the legs 229, 230 is molded to define a plurality of slots 250 having surfaces, edges and/or ledges corresponding to like structure of each slot 50 which has been identified by reference numerals 252 through 255. The projecting supports 260 of each second shelf bracket member 227 cooperate with the slots 250 of each of the two first shelf bracket members 226, 226 precisely in the manner set forth with respect to the operation of the respective first and second shelf bracket members 26, 27 of the two pair of adapter brackets 25 heretofore described relative to FIGS. 1 through 7 of the drawings which are incorporated hereat by reference. Obviously, a major difference between the latter two constructions is that the slots 50 are "open," i.e., pass through the legs 29, 30 whereas the slots 250 are "closed," i.e., do not pass through the legs 229, 230. The latter may at times be considered preferable for aesthetic purposes inasmuch as the slots 250 are essentially hidden by the legs 229, 231. Furthermore, the outer surfaces (unnumbered) of the legs 229, 230 of the first shelf bracket member 226 are relatively flat and uniplanar which might also be considered to be more aesthetic than the undulating exterior configuration of the legs 29, 30, particularly in the area of the slideways 41 thereof. However, both shelf assemblies 10, 210 function identically with respect to vertical adjustment and the prevention of inadvertent or accidental shelf droppage in the manner heretofore described with respect to the shelf 15' of FIGS. 6 and 7. In the case of the shelf 215, should the latter tend to pivot, tilt or cant clockwise under its weight Wt', as viewed in FIGS. 14 and 15, when the projecting supports or pins 260 are in the slideways 241, the upper projecting supports or pins 260 will contact the front flanges 231, 231 of the legs 229, 230 which limit the tilting of the shelf 215 and the eventual introduction of the lowermost projecting supports or pins 260 into the slots 250 to achieve the orientation of the shelf 215 corresponding to the shelf 15' of FIG. 6.

After each hook 216 of the shelf 215 has been hooked upon the front wall 301 of the associated second shelf bracket member 227, the locking nose or ledge 305 of each locking tab 300 engages beneath and locks with a lower edge 306 of each second shelf bracket member 227 to prevent the shelf 215 from being inadvertently or accidentally withdrawn or removed from the second shelf bracket members 227, as is readily apparent from FIG. 15. The locking function is achieved by simply sliding each hook 216 downwardly into each second bracket member 227 which automatically prevents disengagement therebetween until desired by a person pushing the finger/thumb tabs 310 to the left, as viewed in FIG. 15, to effect disengagement of the hooks 216, 216 from the walls 301, 301 of the second shelf bracket members 227, 227.

Another novel refrigerator shelf assembly constructed in accordance with the present invention is illustrated in FIGS. 17 through 23 of the drawings and is generally designated by the reference numeral 100. Components of the shelf assembly 100 which correspond to the like components of the shelf assembly 10 have been prefixed by "100" to identify identical structure without specifically describing the same. For example, as in the case of the shelf assembly 10, the shelf assembly 100 includes a shelf 115 defined by opposite substantially parallel metal shelf brackets 116, 117 unitized to a peripheral edge (unnumbered) of a shelf member 118 of tempered glass by an injection molded encapsulation, rim or border 120 formed in accordance with the method disclosed in U.S. Pat. No. 5,362,149. However, as opposed to the metal support brackets 16, 17 of the shelf assembly 10, each metal shelf bracket 116, 117 of the shelf assembly 100 includes at a rearmost end portion (unnumbered) thereof latch means or pin means 200 (FIG. 18) for effecting vertical stepwise adjustment with respect to vertically spaced support means, slots or openings 150 of a shelf adapter bracket 126 corresponding substantially identically to the first shelf bracket member 26 earlier described. Each metal shelf bracket 116, 117 further includes lateral stabilization (FIGS. 18 and 21) means 220 for intimately slidably engaging trackway side walls 142, 142 of the shelf adapter bracket 126 to reduce sidewise or lateral shelf movement in any adjusted position of the shelf 115 and during vertical upward or vertical downward adjustment thereof with respect to the shelf adapter bracket 126.

Figure 21:
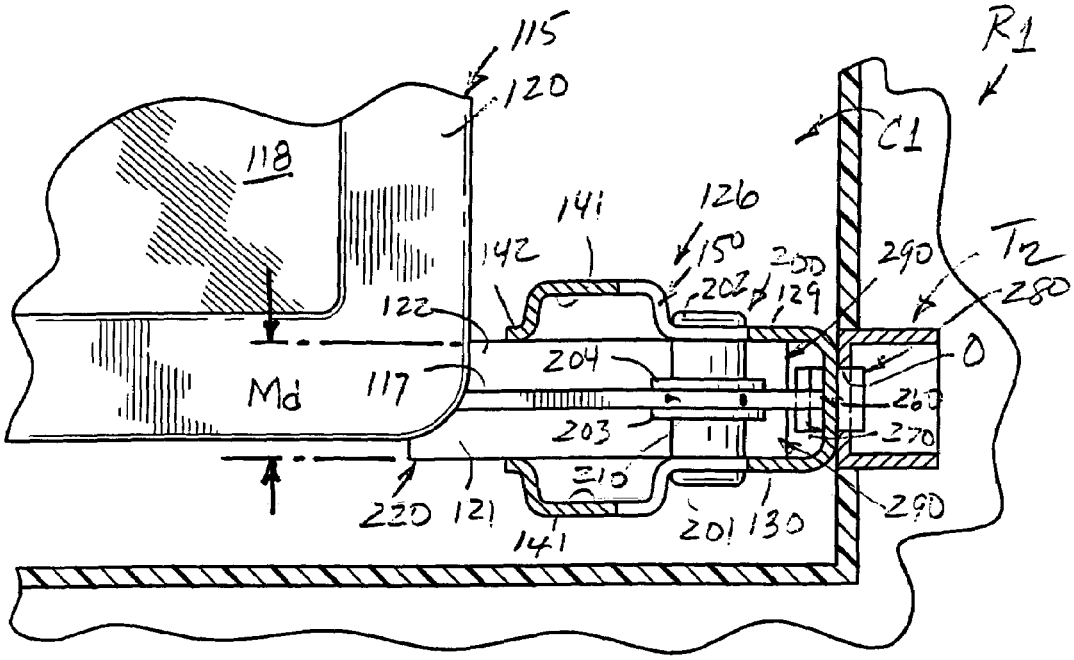
FIG. 21 is a fragmentary cross-sectional view taken generally along line 21-21 of FIG. 19, and illustrates one of the shelf support brackets with the pin resting on supports of the slots, side walls of the slideway engaging the laterally projecting stabilizing ribs, and the pair of support hooks engaged in openings of the conventional refrigerator compartment trackway.
Figure 22:
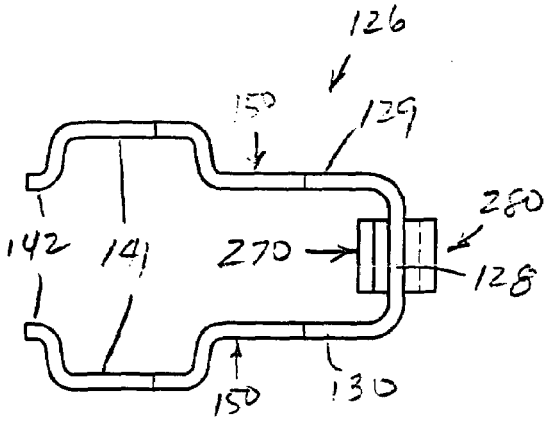
FIG. 22 is an enlarged top plan view of each shelf adaptor bracket of FIG. 17, and illustrates the manner in which the rearwardly and forwardly projecting support hooks and shelf stop hooks, respectively, of a bight or bight wall of the shelf adaptor bracket are struck from the metal thereof.
Figure 23:
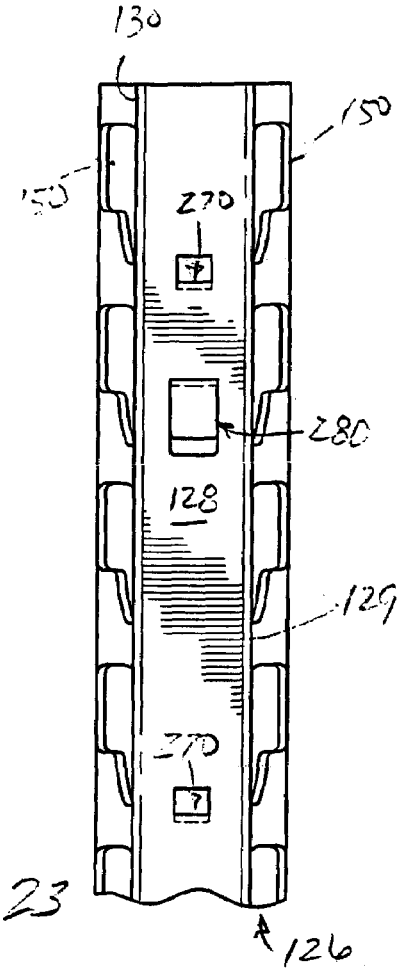
FIG. 23 is a fragmentary rear view of one of the shelf adapter brackets, and illustrates details of the pairs of slots, one of the two rearwardly directed supporting hooks, and two of the forwardly projecting shelf stop hooks.

Each metal shelf bracket 116, 117 further includes means 240 (FIG. 18) in the form of a block of plastic material having a very low coefficient of friction and excellent lubricity which thereby reduces frictional forces during sliding adjustment of the shelf 150 upwardly or downwardly with respect to the shelf adapter bracket 126 particularly as the lubricity block 240 slides in intimate contacting relationship with inner surfaces (unnumbered) of the walls 142, 142 of the shelf adapter bracket 126 (FIG. 21).

Figure 20:
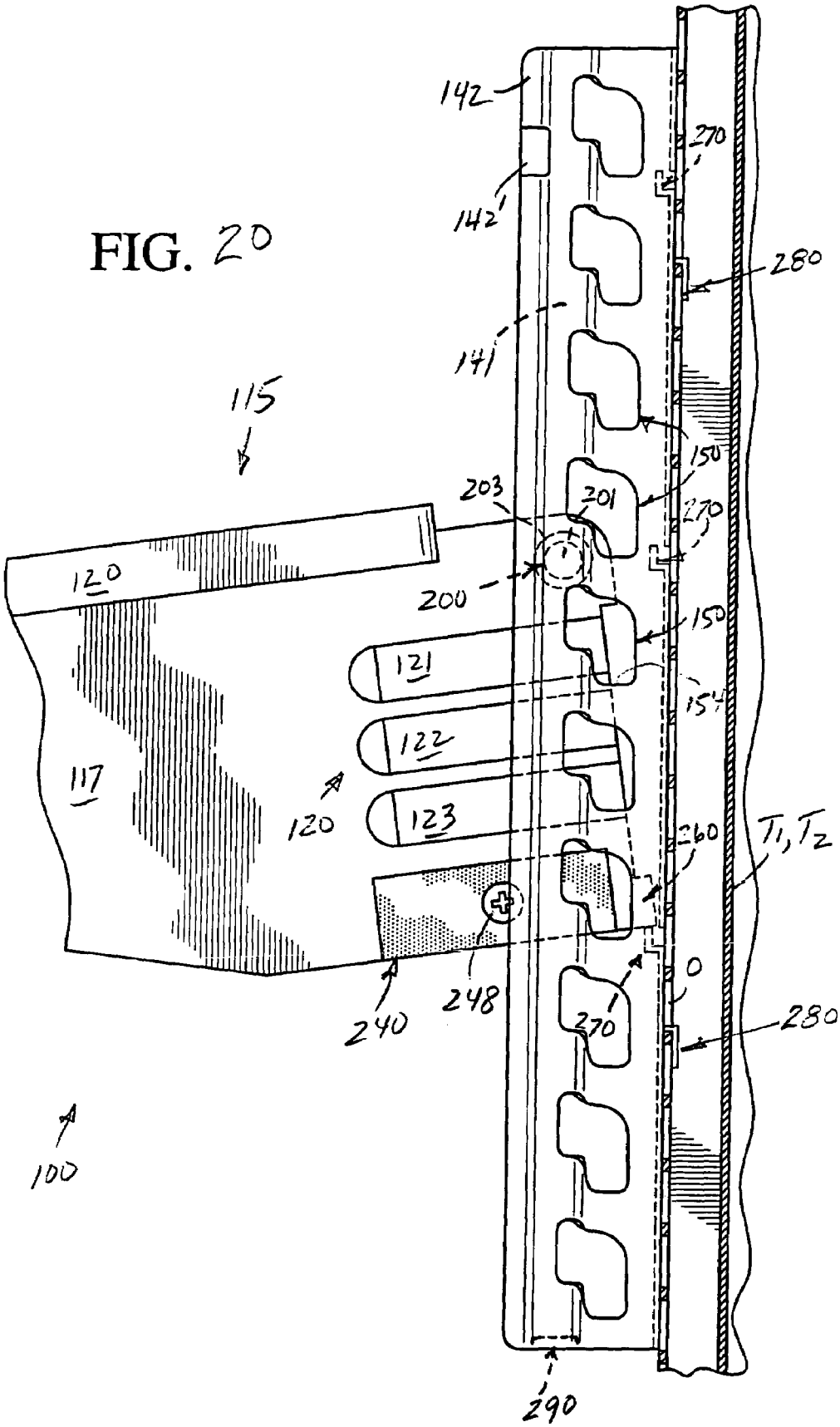
FIG. 20 is a side elevational view of the shelf adapter bracket of FIG. 19, and illustrates the manner in which the shelf will automatically lock in a slightly inclined or canted position if advertently or accidentally released or dropped when a bottom projecting finger of the shelf support bracket engages a lower one of three stops or hooks of the shelf adapter bracket.

Cooperative means 260 (FIGS. 18 and 20) in the form of a projection or projecting nose of each of the shelf brackets 116, 117 cooperates with a plurality of stop means 270 (FIG. 19) struck from a bight wall 128 of each of the shelf adapter brackets 126 to preclude inadvertent or accidental descent of the shelf 115 during adjustment in the manner heretofore described and as is readily apparent from FIG. 20 which illustrates the projection 260 of the metal shelf bracket 117 engaging a lowermost one of a plurality of the stops 270 of the shelf adapter bracket 126.

Figure 17:
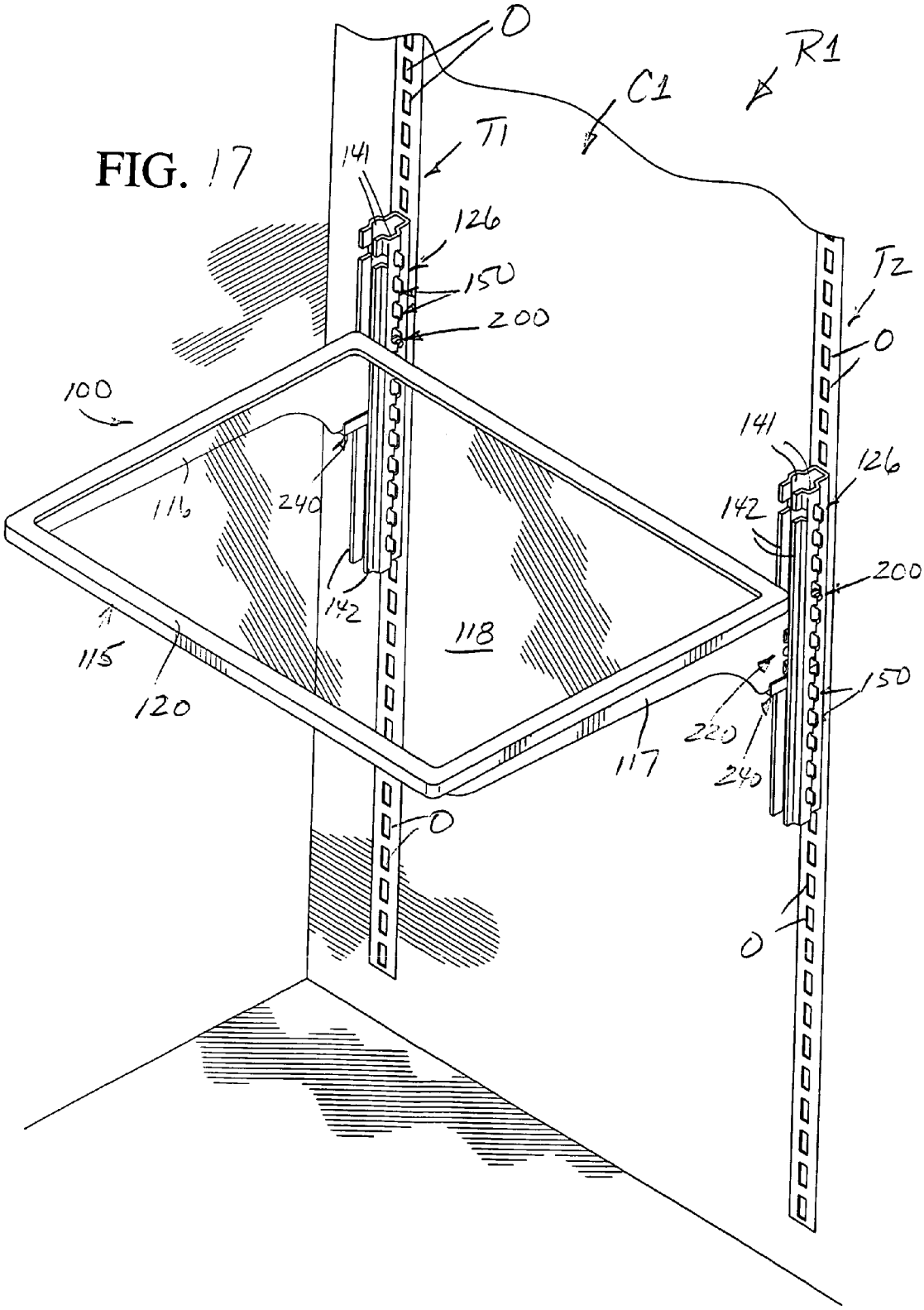
FIG. 17 is a perspective view of a refrigerator, a refrigerator compartment thereof and another novel shelf assembly of the invention defined by a shelf having an injection molded encapsulation or rim unitizing a tempered glass shelf member to a pair of metal shelf support brackets, and a pair of shelf adapter brackets each being secured to conventional slotted vertical trackways in a rear wall of the refrigerator compartment and having opposing slideways and a plurality of vertically spaced slots therein, and the metal shelf support brackets each having oppositely directed projecting supports or pins received in the slots.

Each of the shelf adapter brackets 126 also includes means 280 (FIG. 19-23) for securing the same directly to conventional vertical trackways T1, T2, each having a plurality of slots or openings O, as is conventional in a fresh food compartment or refrigerator compartment C1 of a conventional refrigerator R1 (FIG. 17).

The latching means or latching pin 200 (FIGS. 18 and 21) of each metal shelf bracket 116, 117 is formed of a substantially cylindrical piece of metal and has oppositely projecting aligned end portions 201, 202 (FIG. 21). Prior to each pin 200 being assembled with respect to a circular opening 210 of each metal shelf bracket 116, 117, the pin 200 is provided with only one of two collars 203, 204. Assuming, for example, that only the collar 203 is an integral portion of the pin 200, in lieu of the collar 204, the pin 200 includes an annular portion having a diameter corresponding to the diameter of the opening 210 which permits the same to be freely slid therein and therethrough until the collar 230 abuts against the metal shelf bracket 116, 117. Thereafter, the annular metal collar which projects through the circular shelf bracket opening 210 is upset or staked to form the collar 204. In the latter manner, each pin 200 is a substantially rigid homogeneous single piece of material which is rigidly united to the metal shelf brackets 116, 117 through the collars 203, 204. The specifics of the method of forming the pin 200 beyond that just described are found in Applicant's co-pending application Ser. No. 11/404,011 filed on Apr. 14, 2006 and entitled METHOD OF MANUFACTURING A VERTICALLY ADJUSTABLE SHELF BRACKET, and the totality of the latter disclosure is incorporated herein by reference.

Suffice it to say that the shelf 115 through the latching or support pins 200 and particularly the end portions 201, 202 thereof are adjusted with respect to the shelf adaptor brackets 126, 126 (FIG. 17) in the manner heretofore described with respect to the shelf assembly 10 of FIGS. 1 through 7 of the drawings. Each pin 200 and specifically the axially opposite end portions 201, 202 thereof can be inserted in the slideways 141, 141 of the shelf adapter brackets 126, 126 from above (FIG. 18) or laterally through entry slots 142', 142' in the side walls 142, 142.

Figure 18:
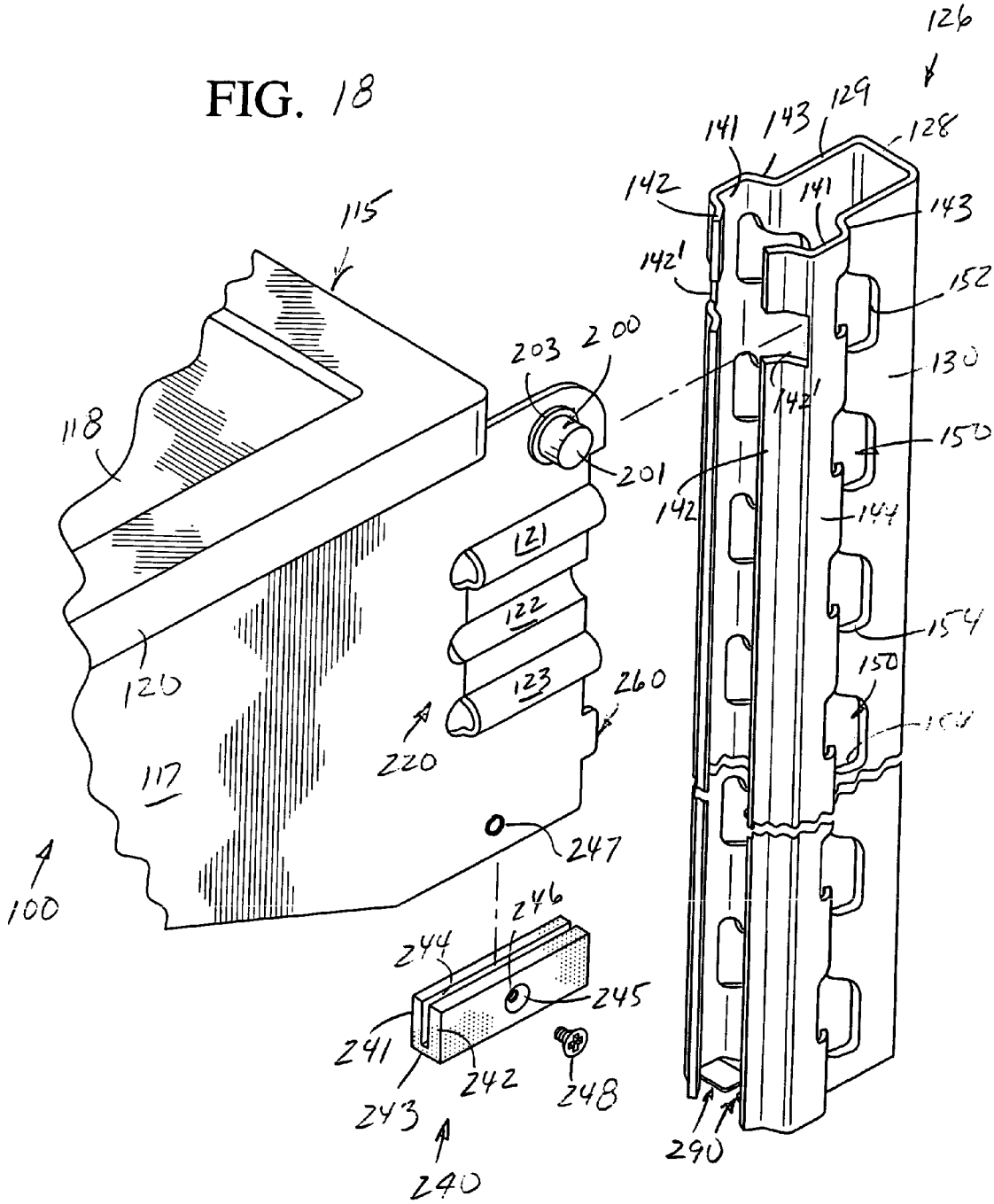
FIG. 18 is a fragmentary exploded perspective view of one of the shelf support brackets and shelf adaptor brackets of FIG. 17, and illustrates details of the slideway and slots of the shelf adapter bracket; and the supporting projecting pin, laterally projecting stabilizing ribs and a block of lubricity increasing material of the metal shelf support bracket.
Figure 19:
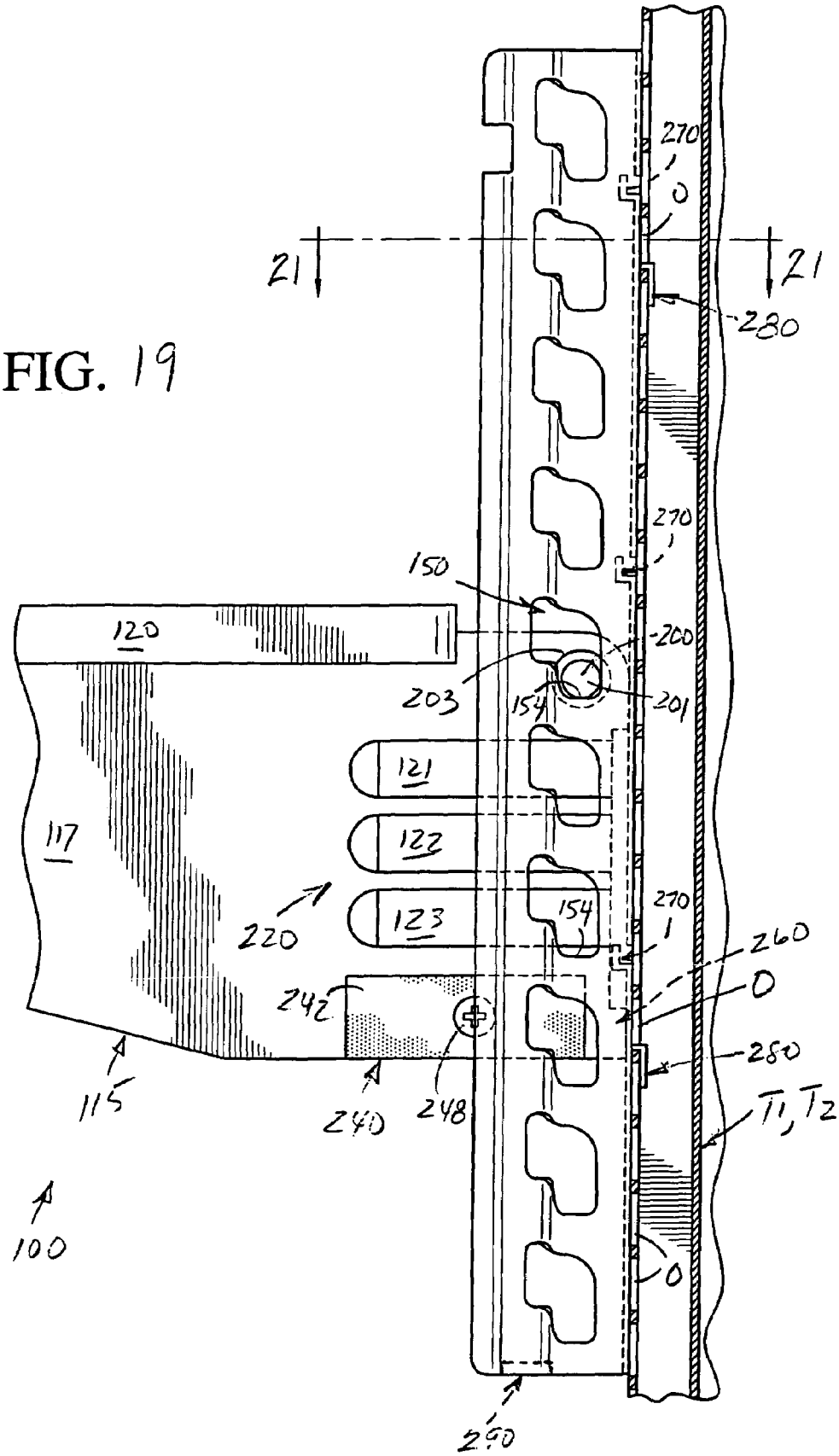
FIG. 19 is a fragmentary side elevational view of one of the shelf adapter brackets, and illustrates the manner in which the projecting pin of the shelf support bracket is seated in a slot of the shelf adapter bracket and a pair of support hooks of the shelf adapter bracket received in slots or openings in one of the conventional refrigerator compartment trackways.

Each of the metal shelf brackets 116, 117 is relatively thin and unless otherwise provided for might tend to wobble, sway or move sidewise or laterally within the shelf adapter brackets 125, particularly under heavy product loads, unless otherwise provided for which is accomplished herein by the lateral stabilizing means 220 (FIGS. 18 and 21). The stabilizing means 220 are designed for intimately slidably engaging the trackway sidewalls 142, 142 of each of the shelf adapter brackets 126 to thereby reduce sidewise shelf movement. The latter is accomplished by forming the means 220 as three ribs 121, 122 and 123 disposed in substantially spaced parallel relationship to each other. The ribs 121, 123 project to one side of the metal shelf brackets 116, 117 whereas the rib 122 projects to an opposite side of each of the metal shelf brackets 116, 117. Through the ribs 121 through 123 are substantially in parallel horizontal spaced relationship to each other, the same can also be inclined or can be of other configurations so long as the maximum distance Md (FIG. 21) between the inboardmost portion of the inboard rib 122 and the outboardmost portion (unnumbered) of either or both of the outboard ribs 121, 123 approximates the same distance Md between the walls 142, 142 in the manner best illustrated in FIG. 21 of the drawings. As is readily apparent from FIG. 21, the innermost rib 122 and the outermost rib 121, as well as the unillustrated lowermost outermost rib 121, engage the respective inner and outer walls 142, 142 of each of the shelf adapter brackets 126 and thereby preclude lateral or sidewise movement of the shelf brackets 116, 117 thereby obviously stabilizing/rigidifying the shelf 115, particularly in its position of use (FIG. 17).

Even through the metal shelf brackets 116, 117 and the shelf adapter brackets 126 are painted and the surfaces thereof are relatively slick, it is preferred that the stabilizing means or lateral movement preventing means 220 and/or ribs 121-123 do not necessarily at all times engage the walls 142, 142 of the shelf adapter brackets 126, 126. In other words, it is highly desirable that the dimensioning of the ribs 121 through 123 is such that they are spaced a transverse maximum distance Md very slightly less than the distance between the walls 142, 142 of the shelf adapter brackets 126, 126 to barely avoid sliding/rubbing friction contact therebetween during adjustment both to decrease frictional contact and, obviously prevent wear and/or scratching of the opposing painted surfaces. In order to maintain such exact distance and aid in low friction sliding, the low coefficient of friction or high lubricity block 240 (FIG. 18) is provided in the form of a generally U-shaped block of plastic material of a generally U-shaped transverse cross-section defined by opposite side walls 241, 242 and a bight or bight wall 243 therebetween. A slot 244 between the walls 241, 242 corresponds substantially to the thickness of the metal support brackets 116, 117. A conical recess 245 is provided in the wall 242 and a cylindrical opening 246 aligns with an opening 247 formed along a lower edge (unnumbered) of each of the shelf support brackets 116, 117. After the lower edge of each shelf support bracket 116, 117 is slid into an associated slot 244, a sheet metal screw 248 is threaded into the opening 247 to retain the block 240 appropriately assembled to its associated shelf bracket 116, 117. The distance between exterior surfaces (unnumbered) of the side walls 241, 242 is very slightly greater than the maximum distance Md heretofore described from the innermost surface of the rib 122 to the outermost surface of either of the ribs 121, 123, with the latter distances being measured normal to each other which brings the surfaces (unnumbered) of the walls 241, 242 into intimate sliding relationship to the walls 142, 142 of the shelf adapter brackets 126, 126. In the latter position, the ends of the ribs 121-123 preferably are extremely virtually indiscernibly spaced from the walls 142, 142 whereby major sliding engagement between the walls 142, 142 is between the latter and the outside surfaces of the side walls 241, 242 of the lubricity block 240.

As in the case of the shelf 15, 15' heretofore described particularly with respect to FIG. 6, the shelf 115 will under its own weight and/or with product thereon will, if advertently or accidentally released, pivot, tilt or cant from a horizontal position (FIG. 19) counterclockwise, as viewed in FIG. 20, to the position illustrated therein along a curved line of travel corresponding to the curve line of travel A associated with the shelf 15' of FIG. 6. The latter movement in the case of the shelf 115 brings each of the projecting pins 200 into bearing engagement with the front leg portions 142, 142 of the slideways 141, but in this case the shelf brackets 116, 117 each include only a single pin 200 and in lieu of an additional pin or pins, each shelf bracket 116, 117 includes the shelf stop projections or shelf stop noses 260 which engage the stops or stop hooks 270 (FIG. 20) of each shelf adapter bracket 126. The projections or noses 260 are vertically aligned with the stops or stop hooks 270, and should the shelf 150 move to the position shown in FIG. 20, the nose 260 of each of the shelf brackets 116, 117 will engage the nearest lowermost stop 270 of the bight wall 128 of each shelf adapter bracket 126 in the manner clearly evident in FIG. 20 of the drawings. Three upwardly directed stops or stop hooks 270 are illustrated in FIG. 20 of the drawings, but it is to be understood that more or less than the latter number of stops 270, may be provided as need be, particularly by adding additional stops 270 thereto to limit incremental inadvertent/accidental downward descent of the shelf 115.

As is best illustrated in FIGS. 20 through 23, the means 280 for securing each of the shelf adapter brackets 126, 126 and the slideways/trackways 141, 141 and supports 154, 154 associated therewith to each of the conventional refrigerator compartment tracks or trackways T1, T2 utilizing the openings or slots O thereof are a pair of downwardly directed hooks with each hook being engaged against a lower edge (unnumbered) of selected ones of the openings O of the compartment C1, as is readily apparent in FIG. 20 of the drawings. Thus, by utilizing the shelf adapter brackets 126 in the manner described, conventional shelf assemblies which would be hooked into the openings O of the conventional trackways T1, T2 and might be readily inadvertently or accidentally dropped during adjustment is precluded through the utilization of the novel shelf adapter brackets 126, 126. Thus, the shelf adapter brackets 126, 126 initially permit "rough" adjustment by hooking the hooks 280, 280 of the shelf adapter brackets 126, 126 in the desired horizontally aligned and vertically spaced openings O of the conventional refrigerator compartment trackways T1, T2. Thereafter, the shelf 115 can be slidably adjusted selectively along the length of the shelf adapter brackets 126, 126 without, of course, withdrawing the pins 200, 200 from the slideways or trackways 141, 141. However, should the shelf 115 be accidentally released when the pins 200, 200 are in the slideways 141, 141, the automatic tilting or canting to the position shown in FIG. 20 and earlier described brings the shelf stop projections or noses 260 of each of the shelf support brackets 116, 117 into contact with an associated stop 270 of the shelf adapter brackets 126, 126, thereby precluding further undesired downward descent of the shelf 115 or the total disengagement thereof from the shelf adapter brackets 126, 126 through bottoms thereof.

Each of the shelf adapter brackets 126, 126 also include means 290 in the form of opposing stop flanges 290, 291 at lowermost or bottom edges (unnumbered) of the shelf adapter brackets 126, 126. Thus, the shelf 115 can never drop vertically downwardly outwardly of the shelf adapter brackets 126, 126 and instead must be intentionally disassembled through the open upper ends thereof.

Figure 24:
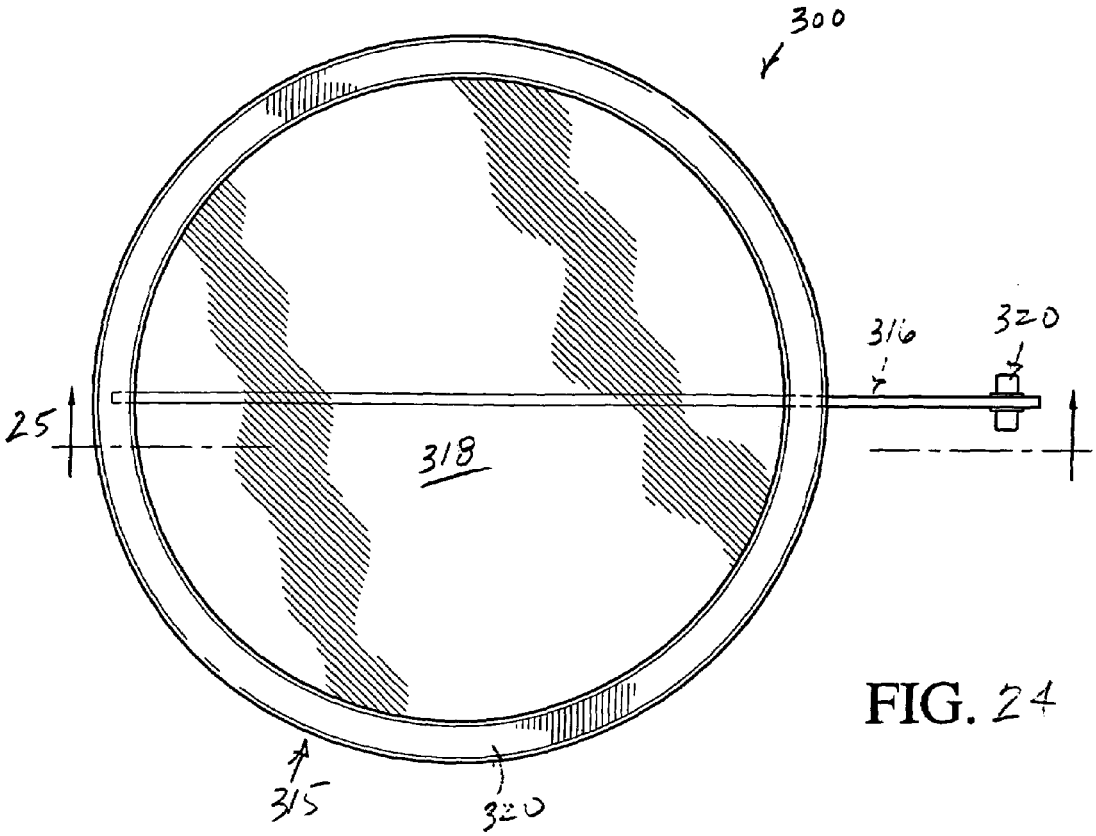
FIG. 24 is a top perspective view of another shelf which can be utilized in the shelf assemblies heretofore described, and illustrates a circular tempered glass panel encapsulated by an injection molded rim or encapsulation which diametrically attaches thereto a single metal shelf bracket carrying a pin and a lubricity increasing block of material.
Figure 25:
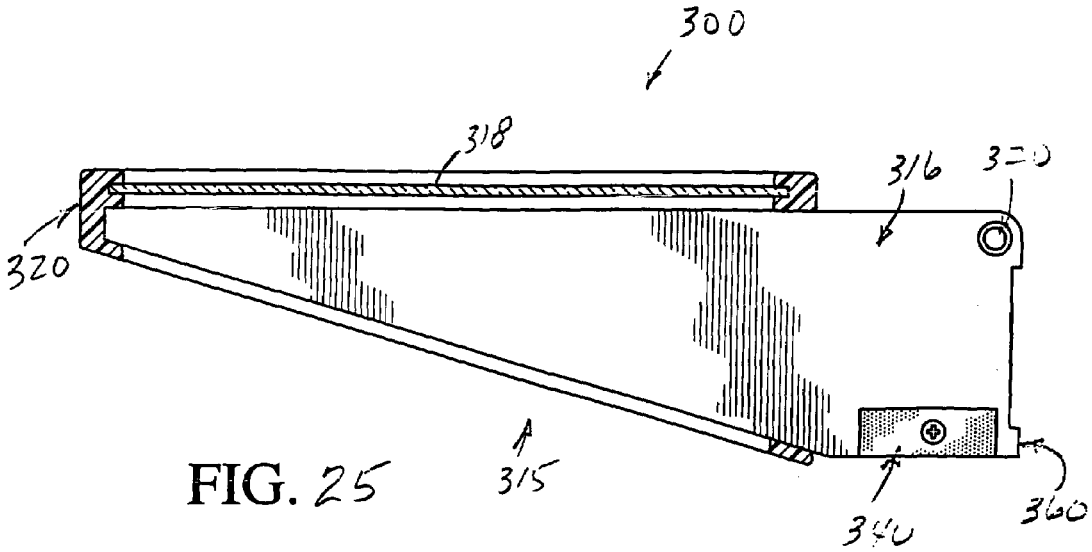
FIG. 25 is a cross-sectional view taken generally along line 25-25 of FIG. 24, and illustrates details of the metal shelf bracket including a rearwardly projected shelf stop nose thereof.

Another shelf assembly 300 (FIGS. 24 and 25) which includes components substantially identical to those heretofore described with respect to the shelf assemblies 10 and 100 has been prefixed by reference numeral "300" to identify such identical components. For example, the shelf assembly 300 of FIGS. 24 and 25 includes a shelf 315 defined by a single metal shelf bracket 316 unitized to a peripheral edge (unnumbered) of a substantially circular shelf member 318 of tempered glass by an injection molded encapsulation, rim or border 320 formed in accordance with U.S. Pat. No. 5,362,149. However, since the metal shelf bracket 316 diametrically spans the tempered glass shelf member 318, the latter is preferably translucent or opaque to reduce or preclude visibility of the shelf bracket 316 from above. The shelf 315 can be utilized with any one of the shelf adapter brackets 26, 126. Since the shelf 315 is relatively small and is designed for supporting relatively lightweight articles thereon, the shelf bracket 316 is shown devoid of the means 260 in the form of the three stabilizing ribs 121 through 123 for preventing sidewise or lateral shifting or wobbling of the shelf 315 relative to an associated shelf adapter bracket 126. However, such shifting or wobbling is precluded through the utilization of a lubricity block 340. However, the shelf support bracket 116 may be provided with ribs corresponding to the ribs 121, 122 and 123 (FIG. 18). The shelf assembly 300 also includes as part of the single shelf bracket 316 a vertical latching or latch adjusting pin 320 corresponding to the pin 200 of the shelf brackets 116, 117 and a projecting stop nose, projection or stop 360.

Although a preferred embodiment of the invention has been specifically illustrated and described herein, it is to be understood that minor variations may be made in the apparatus without departing from the spirit and scope of the invention, as defined by the appended claims.

What is claimed is:

1. A shelf assembly particularly adapted to effect selective vertical adjustment of a shelf in a refrigerator compartment absent inadvertent, accidental or undesired downward shelf movement during vertical adjustment thereof comprising a substantially U-shaped in transverse cross section vertical trackway, a shelf; said shelf including a forward portion, a rearward portion slidingly disposed within said trackway and a medial portion between said forward and rearward portions; said vertical trackway including a plurality of vertically spaced latching means for selective latching engagement with latching means at said rearward portion of said shelf, a vertically extending guide channel provided adjacent a front of said vertical trackway allowing vertical adjustment of said shelf, said trackway including means for automatically stopping undesired downward vertical travel of said shelf relative to said trackway after the unlatching of said shelf and trackway latching means by a bottom portion of said shelf rearward portion pivoting into abutment with a rearward portion of said trackway, said stopping means including a stop member disposed within said trackway and projecting toward said shelf, said stop member being spaced a distance below at least several of said plurality of spaced latching means, and means for securing said trackway in a refrigerator compartment.

2. The shelf assembly as defined in claim 1 wherein said trackway securing means include hook means for hooking engagement in an opening of a refrigerator compartment.

3. The shelf assembly as defined in claim 1 including means for precluding disassembly of said shelf and trackway by vertical downward movement of said shelf toward a lowermost end of said trackway.

4. The shelf assembly as defined in claim 1 wherein said shelf member rearward portion includes means for increasing the lubricity thereof to thereby reduce the force required to adjust the shelf relative to the trackway.

5. The shelf assembly as defined in claim 1 wherein said shelf member rearward portion includes means for intimately slidably engaging said trackway side walls to thereby reduce sidewise shelf movement.

6. The shelf assembly as defined in claim 1 wherein shelf member rearward portion includes member for engaging said trackway stopping means during undesired vertical downward travel of said shelf.

7. The shelf assembly as defined in claim 1 wherein said shelf member rearward portion includes member projecting rearwardly from said shelf member rearward portion for engaging said trackway stopping means during undesired vertical downward travel of said shelf.

8. The shelf assembly as defined in claim 1 wherein shelf includes a shelf stop aligned for vertical downward stopping contact against said trackway shelf stop member.

9. The shelf assembly as defined in claim 1 wherein said shelf latching means includes a latching member carried by said shelf member rearward portion, and said trackway latching means are a plurality of edge portions selectively engageable by said shelf latching member to effect vertical shelf adjustment.

10. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, and said shelf latching member is disposed in substantially transverse relationship to said vertical plane.

11. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, and said shelf latching member is disposed in substantially transverse spanning relationship to said vertical plane.

12. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, and said shelf latching member is a pin disposed in substantially transverse relationship to said vertical plane.

13. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, and said shelf latching member is a pin disposed in substantially transverse spanning relationship to said vertical plane.

14. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, said shelf latching member is a pin disposed in substantially transverse spanning relationship to said vertical plane, said shelf member rearward portion includes an opening, said pin includes pin end portions projecting outwardly from opposite sides of said opening, said pin has a pair of collars larger than said opening and sandwiching said opening therebetween, and at least one of said collars is formed of material of its associated pin end portion swaged from a size substantially corresponding to said opening to a size larger than the opening to thereby retain said pin in said opening.

15. The shelf assembly as defined in claim 1 wherein said shelf latching means includes a latching member carried by said shelf member rearward portion, said trackway latching means are a plurality of edge portions selectively engageable by said shelf latching member to effect vertical shelf adjustment, said shelf member rearward portion lies at least partially in a vertical plane, said shelf latching member is a pin disposed in substantially transverse spanning relationship to said vertical plane, said shelf member rearward portion includes an opening, said pin includes pin end portions projecting outwardly from opposite sides of said opening, said pin has a pair of collars larger than said opening and sandwiching said opening therebetween, at least one of said collars is formed of material of its associated pin end portion swaged from a size substantially corresponding to said opening to a size larger than the opening to thereby retain said pin in said opening, and said pin is made of metal.

16. The shelf assembly as defined in claim 2 including means for precluding disassembly of said shelf and trackway by vertical downward movement of said shelf toward a lowermost end of said trackway.

17. The shelf assembly as defined in claim 2 wherein shelf member rearward portion includes means for increasing the lubricity thereof to thereby reduce the force required to adjust the shelf relative to the trackway.

18. The shelf assembly as defined in claim 2 wherein said shelf member rearward portion includes means for intimately slidably engaging said trackway side walls to thereby reduce sidewise shelf movement.

19. The shelf assembly as defined in claim 2 wherein said shelf latching means includes a latching member carried by said shelf member rearward portion, and said trackway latching means are a plurality of edge portions selectively engageable by said shelf latching member to effect vertical shelf adjustment.

20. The shelf assembly as defined in claim 1 including means for defining a second vertical trackway, said second vertical trackway including a second plurality of vertically spaced latching means for selectively latching engagement with second latching means of said shelf, said first-mentioned and second trackways being located in substantially vertical parallel sidewise spaced relationship to each other, a vertically extending second guide channel provided adjacent a front of said second vertical trackway allowing vertical adjustment of said shelf, said second trackway including second means for stopping undesired vertical downward travel of said shelf relative to said second trackway after unlatching of said shelf and second trackway latching means, said second stopping means including a stop member disposed within said second trackway and projecting toward said shelf, said second stop member being spaced a distance below at least several of said second plurality of spaced latching means and second means for securing said second trackway in a refrigerator compartment with said first-mentioned and second trackway respective first-mentioned and second plurality of vertically spaced latching means being in substantially horizontally aligned relationship.

21. The shelf assembly as defined in claim 20 wherein said shelf includes first and second shelf members in substantially side-by-side spaced relationship, a support spanning said first and second shelf members, each first and second shelf member having forward, medial and rearward shelf member portions, and said first and second shelf member rearward portions including the respective first mentioned and second latching means of said shelf.

22. The shelf assembly as defined in claim 21 wherein said first-mentioned and second trackway securing means include respective first and second hook means of said respective first and second shelf members rearward portions for hooking engagement each in one of a pair of openings of a refrigerator compartment.

23. The shelf assembly as defined in claim 21 including second means for precluding disassembly of said second shelf and second trackway by vertical downward movement of said shelf toward a lowermost end of said second trackway.

24. The shelf assembly as defined in claim 21 wherein said first-mentioned and second shelf member rearward portions each includes means for increasing the lubricity thereof to thereby reduce the force required to adjust the shelf relative to said trackways.

25. The shelf assembly as defined in claim 21 wherein said first-mentioned and second shelf member rearward portions each include means for intimately slidably engaging said first-mentioned and second trackway sidewalls to thereby reduce sidewise shelf movement.

26. The shelf assembly as defined in claim 21 wherein said first-mentioned and second shelf member rearward portions each includes member for engaging said respective first-mentioned and second trackway stopping means during undesired vertical downward travel of said shelf.

27. The shelf assembly as defined in claim 21 wherein said first-mentioned and second shelf member rearward portions each includes member projecting rearwardly from said first mentioned and second shelf rearward portions for engaging said respective first-mentioned and second trackway stopping means during undesired vertical downward travel of said shelf.

28. The shelf assembly as defined in claim 21 wherein said first-mentioned and second shelf member rearward portions each includes a shelf stop aligned for vertical downward stopping contact against said first-mentioned and second trackway shelf stop member.

29. The shelf assembly as defined in claim 21 wherein said first-mentioned and second shelf latching means include respective first and second shelf latching members carried by said respective first and second shelf member rearward portions, and said first-mentioned and second trackway latching means are each a plurality of edge portions selectively engageable by said respective first and second latching members to effect vertical shelf adjustment.

30. The shelf assembly as defined in claim 21 wherein said first-mentioned and second shelf latching means include respective first and second shelf latching members carried by said respective first and second shelf member rearward portions, said first-mentioned and second trackway latching means are each a plurality of edge portions selectively engageable by said respective first and second latching members to effect vertical shelf adjustment, each shelf member rearward portion lies at least partially in a vertical plane, and said first and second shelf latching members are each disposed in substantially transverse relationship to said vertical plane.

31. The shelf assembly as defined in claim 21 wherein said first-mentioned and second shelf latching means include respective first and second shelf latching members carried by said respective first and second shelf member rearward portions, said first-mentioned and second trackway latching means are each a plurality of edge portions selectively engageable by said respective first and second latching members to effect vertical shelf adjustment, each shelf member rearward portion lies at least partially in a vertical plane, and said first and second shelf latching members are each disposed in substantially transverse spanning relationship to said vertical plane.

32. The shelf assembly as defined in claim 21 wherein said first-mentioned and second shelf latching means include respective first and second shelf latching members carried by said respective first and second shelf member rearward portions, said first-mentioned and second trackway latching means are each a plurality of edge portions selectively engageable by said respective first and second latching members to effect vertical shelf adjustment, each shelf member rearward portion lies at least partially in a vertical plane, and said first and second shelf latching members are each a pin disposed in substantially transverse relationship to said vertical plane.

33. The shelf assembly as defined in claim 22 including second means for precluding disassembly of said shelf and second trackway by vertical downward movement of said shelf toward a lowermost end of said second trackway.

34. The shelf assembly as defined in claim 22 wherein said first-mentioned and second trackway is each defined in part by a respective first and second pair of spaced side walls, said first-mentioned and second shelf member rearward portions being disposed in sliding relationship between said respective first and second pair of spaced sidewalls, and said first-mentioned and second shelf member rearward portions each includes means for increasing the lubricity thereof to thereby reduce the force required to adjust the shelf relative to said trackways.

35. The shelf assembly as defined in claim 22 wherein said first-mentioned and second trackway is each defined in part by a respective first and second pair of spaced side walls, said first-mentioned and second shelf member rearward portions being disposed in sliding relationship between said respective first and second pair of spaced sidewalls, and said first-mentioned and second shelf member rearward portions each include means for intimately slidably engaging said first-mentioned and second trackway sidewalls to thereby reduce sidewise shelf movement.

36. The shelf assembly as defined in claim 22 wherein said first-mentioned and second shelf latching means include respective first and second shelf latching members carried by said respective first and second shelf member rearward portions, and said first-mentioned and second trackway latching means are each a plurality of edge portions selectively engageable by said respective first and second latching members to effect vertical shelf adjustment.

37. A shelf assembly particularly adapted to effect selective vertical adjustment of a shelf in a refrigerator compartment absent inadvertent, accidental or undesired downward shelf movement during vertical adjustment thereof comprising a substantially U-shaped in transverse cross section vertical trackway, a shelf; said shelf including a forward portion, a rearward portion slidingly disposed within said trackway and a medial portion between said forward and rearward portions; said vertical trackway including a plurality of vertically spaced latching means for selective latching engagement with latching means at said rearward portion of said shelf, a vertically extending guide channel provided adjacent a front of said vertical trackway allowing vertical adjustment of said shelf, said trackway including means for automatically stopping undesired downward vertical travel of said shelf relative to said trackway after the unlatching of said shelf and trackway latching means by a bottom portion of said shelf rearward portion pivoting into abutment with a rearward portion of said trackway, said stopping means including a stop member disposed within said trackway projecting toward said shelf spaced a distance below at least several of said plurality of trackway vertically spaced latching means, and said stop member being in vertically aligned relationship to a stop member abutment portion of said shelf.

38. The shelf assembly as defined in claim 37 wherein said trackway stop member is formed from the material of said trackway.

39. The shelf assembly as defined in claim 37 wherein said trackway stop member is formed from the material of a bight portion of said substantially U-shaped trackway.

40. A shelf assembly particularly adapted to effect selective vertical adjustment of a shelf in a refrigerator compartment absent inadvertent, accidental or undesired downward shelf movement during vertical adjustment thereof comprising a substantially U-shaped in transverse cross section vertical trackway, a shelf; said shelf including a forward portion, a rearward portion slidingly disposed within said trackway and a medial portion between said forward and rearward portions; said vertical trackway including a plurality of vertically spaced latching means for selective latching engagement with latching means at said rearward portion of said shelf, said shelf latching means being a pin, said trackway including means for automatically stopping undesired downward vertical travel of said shelf relative to said trackway after the unlatching of said shelf and trackway latching means by a bottom portion of said shelf rearward portion pivoting into abutment with a rearward portion of said trackway said stopping means including a stop member disposed within said trackway and projecting toward said shelf, said stop member being spaced a distance below at least several of said plurality of spaced latching means, said trackway including at least one vertical guide channel along which said shelf latching pin can freely vertically slide, said trackway latching means are a plurality of vertically spaced latching edges of said trackway which selectively engage said shelf latching pin to prevent vertical adjustment of said shelf, and said vertical adjustment effecting means is defined by a transverse transition edge between said vertical guide channel and each of said vertically spaced latching edges.

41. The shelf assembly as defined in claim 40 wherein said vertical trackway includes at least one vertical edge, and said vertical guide channel is disposed between said at least one vertical edge and said vertically spaced latching edges and at least in part defines said transverse transition edges.

42. A shelf assembly particularly adapted to effect selective vertical adjustment of a shelf in a refrigerator compartment absent inadvertent, accidental or undesired downward shelf movement during vertical adjustment thereof comprising a substantially U-shaped in transverse cross section vertical trackway, a shelf; said shelf including a forward portion, a rearward portion slidingly disposed within said trackway and a medial portion between said forward and rearward portions; said vertical trackway including a plurality of vertically spaced latching means for selective latching engagement with latching means at said rearward portion of said shelf, a vertically extending guide channel provided adjacent a front of said vertical trackway allowing vertical adjustment of said shelf, said trackway including means automatically for stopping undesired downward vertical travel of said shelf relative to said trackway after the unlatching of said shelf and trackway latching means by a bottom portion of said shelf rearward portion pivoting into abutment with a rearward portion of said trackway, said stopping means including a stop member disposed within said trackway and projecting toward said shelf, said stop member being spaced a distance below at least several of said plurality of spaced latching means, means for securing said trackway in a refrigerator compartment, and said trackway securing means including at least a pair of downwardly directed hook means for hooking engagement in openings of a refrigerator compartment.

43. A shelf assembly particularly adapted to effect selective vertical adjustment of a shelf in a refrigerator compartment absent inadvertent, accidental or undesired downward shelf movement during vertical adjustment thereof comprising a substantially U-shaped in transverse cross section vertical trackway, a shelf slidable along said vertical trackway, said shelf including a forward portion slidingly disposed within said trackway, a rearward portion and a medial portion between said forward and rearward portions; said vertical trackway including a plurality of vertically spaced latching means for selective latching engagement with latching means of said shelf, a vertically extending guide channel provided adjacent a front of said vertical trackway allowing vertical adjustment of said shelf, said trackway including means for automatically stopping undesired downward vertical travel of said shelf relative to said trackway after the unlatching of said shelf and trackway latching means by a bottom portion of said shelf rearward portion pivoting into abutment with a rearward portion of said trackway, said stopping means including a stop member disposed within said trackway and projecting toward said shelf, said stop member being spaced a distance below at least several of said plurality of spaced latching means, and said shelf stopping means are located substantially adjacent a lowermost end portion of said vertical trackway.

44. The shelf assembly as defined in claim 43 wherein said trackway stopping members is a projection formed from the material of said vertical trackway projecting into the U-shape thereof.

* * * * *